US010386118B2

(12) United States Patent
Lee et al.

(10) Patent No.: US 10,386,118 B2
(45) Date of Patent: Aug. 20, 2019

(54) DRYING MACHINE

(71) Applicant: LG ELECTRONICS INC., Seoul (KR)

(72) Inventors: Sangik Lee, Seoul (KR); Youngjoo Lee, Seoul (KR); Woohee Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 650 days.

(21) Appl. No.: 14/994,261

(22) Filed: Jan. 13, 2016

(65) Prior Publication Data

US 2016/0201985 A1 Jul. 14, 2016

(30) Foreign Application Priority Data

Jan. 13, 2015 (KR) ..... 10-2015-0006003

(51) Int. Cl.
*F26B 5/04* (2006.01)
*D06F 58/20* (2006.01)
*D06F 58/24* (2006.01)

(52) U.S. Cl.
CPC ..... *F26B 5/04* (2013.01); *D06F 58/20* (2013.01); *D06F 58/24* (2013.01)

(58) Field of Classification Search
CPC ..... D06F 58/02; D06F 58/24; D06F 58/20; F26B 5/04
USPC ..... 34/77, 73, 130; 454/85, 93, 121, 198, 454/148, 159–161, 233, 236
See application file for complete search history.

(56) References Cited

U.S. PATENT DOCUMENTS

2005/0138831 A1 6/2005 Lee
2009/0094852 A1 4/2009 Tatsumi et al.
2010/0192397 A1* 8/2010 Kim ..... D06F 58/206 34/73
2012/0096739 A1* 4/2012 Clark ..... D06F 58/02 34/553

FOREIGN PATENT DOCUMENTS

CN 1936154 3/2007
CN 201047034 4/2008
(Continued)

OTHER PUBLICATIONS

European Search Report for Application EP 16 15 0782 dated May 31, 2016.

(Continued)

*Primary Examiner* — Kenneth Rinehart
*Assistant Examiner* — Bao D Nguyen
(74) *Attorney, Agent, or Firm* — KED & Associates LLP

(57) ABSTRACT

A drying machine may include a condensation duct for accommodating a condenser, a first drying duct connected to a rear end of the condensation duct and to a drying fan housing accommodating a drying fan, and a second drying duct connected to the drying fan housing and to a drum. The drying machine may also include a first drying duct drain outlet formed in the lower portion of the first drying duct, and an outer rib, which is provided at the side edge of the first drying duct drain outlet that is close to the drying fan housing and that extends upward, so as to prevent condensed water, introduced through the condensation duct, from flowing over the first drying duct drain outlet.

23 Claims, 18 Drawing Sheets

(56) References Cited

FOREIGN PATENT DOCUMENTS

| | | | | | |
|---|---|---|---|---|---|
| CN | 101736566 | | | 6/2010 | |
| JP | 2007-143611 | A | | 6/2007 | |
| JP | 2007-215833 | A | | 8/2007 | |
| JP | 2007215833 | A | * | 8/2007 | |
| JP | 2009-061217 | A | | 3/2009 | |
| JP | 4713874 | | | 6/2011 | |
| JP | 4713874 | B2 | * | 6/2011 | ..... D06F 25/00 |
| JP | 2015-107156 | | | 6/2015 | |
| KR | 10-2005-0066299 | A | | 6/2005 | |
| WO | WO 2012/146533 | | | 11/2012 | |

OTHER PUBLICATIONS

Chinese Office Action dated Jul. 19, 2017 issued in Application No. 201610013839.8 (English translation attached).

* cited by examiner

DRYING MACHINE

CROSS-REFERENCE TO RELATED APPLICATION

This application claims priority under 35 U.S.C. § 119 to Korean Application No. 10-2015-0006003, filed Jan. 13, 2015, the subject matter of which is incorporated herein by reference.

BACKGROUND

1. Field

Embodiments may relate to a drying machine, and more particularly to a drying machine capable of efficiently preventing condensed water from flowing into a drum or a heater. Embodiments may relate to a drying machine that is easy to manufacture and assemble and that includes a variable base in which a flow channel is capable of being changed depending on a type of heat source for drying.

2. Background

A drying machine is intended to dry clothes. A drying machine is an apparatus for removing moisture from clothes by supplying hot air to clothes.

A drying machine may use an electric heater, a gas heater or a heat pump as a heat source for heating air. Drying machines may be classified based on a kind (or type) of heat source.

Drying machines may also be classified based on the manner in which air flows. An exhaust-type drying machine is intended to remove moisture from clothes and discharge high-temperature and high-humidity air to the outside. A circulation-type drying machine is intended to reuse high-temperature and high-humidity air through circulation without discharging the air to the outside. The circulation-type drying machine operates to condense the moisture in the high-temperature and high-humidity air and heat the air for reuse. The circulation-type drying machine may also be referred to as a condensation-type drying machine. More specifically, the condensation-type drying machines may be classified as a water-cooling type drying machine, an air-cooling type drying machine and/or a heat pump-type drying machine.

A large number of drying machines may be embodied as a combination of an exhaust-type drying machine and a circulation-type drying machine. Therefore, it may be difficult to distinguish an exhaust-type drying machine from a circulation-type drying machine.

Drying machines may also be classified based on the shape of the clothing container for containing clothes to be dried. A drying machine in which a clothing container has a drum shape and rotates about the horizontal axis may be referred to as a horizontal drum-type drying machine. On the other hand, a drying machine in which a clothing container has a drum shape and rotates about the vertical axis may be referred to as a vertical drum-type drying machine. A drying machine in which the clothing container is secured to inside of the cabinet may be referred to as a cabinet-type drying machine (or a refresher).

Circulation-type drum drying machines may be used in the home. Heater-type drying machines, which employ electric heaters as the heat source for air, have been extensively used. However, heat pump-type drying machines, which use a refrigerating cycle, have been used.

Heater-type drying machine and heat pump-type drying machine may be described.

FIG. 1 is a schematic conceptual view showing a heater-type drying machine. Other arrangements and configurations may also be provided.

As shown in FIG. 1, the heater-type drying machine may include a drum 10 and an air circulation unit 20 for circulating air through the drum 10. The air, which is discharged from the drum 10, may flow into the drum 10 again through the air circulation unit 20. Consequently, the air is circulated through the air circulation unit 20. A drying fan 50 is provided for air circulation. The drying fan 50 is provided at the air circulation unit 20 to generate air flow.

The air circulation unit 20 may include an additional duct, a portion of which may be formed in a base of the drying machine. The drum 10 may also be referred to as a part of the air circulation unit 20.

In order to dry clothes in the drum 10, air may be heated by means of a heater, such as an electric heater, for example. The heated air flows into the drum 10 to remove moisture from the clothes. The air, which has high temperature and high humidity due to the removal of moisture, may be discharged from the drum 10, and may flow into a condenser 40. A filter 30 for removing extraneous substances, such as lint in the air, may be provided between the drum 10 and the condenser 40. The filter may be a lint filter.

The high-temperature and high-humidity air may be changed into dried air by condensation of moisture in the condenser 40. The high-temperature and high-humidity air may exchange heat with external air having a lower temperature in the condenser 40. In the course of the heat exchange, moisture contained in the high-temperature and high-humidity air may be condensed and removed. The condenser 40 may be provided with a cooling fan 45 for introduction and discharge of low-temperature external air. The cooling fan 45 may be provided in a cooling channel 46. The cooling channel 46 may supply external air to the condenser 40, and discharge the external air to the outside of the drying machine. The condenser 40 in the heater-type drying machine may be a structure adapted to allow the air circulation unit 20 to intersect with the cooling channel 46.

The low-temperature air, discharged from the condenser 40, may be heated by the heater 60, and may thus be converted into high-temperature dried air. The high-temperature dried air may flow into the drum 10 again.

Accordingly, air is circulated through the drum 10, the condenser 40, the drying fan 50 and the heater 60, and is dried through procedures of heating and condensing the circulating air.

The drying machine shown in FIG. 1 is constructed such that air is blown into the drum 10 from the rear of the drum 10. Accordingly, the drying machine may be referred to as blower-type drying machine. In the drum 10 shown in FIG. 1, the right side of the drum 10 is the front face and the left side of the drum 10 is the rear face. Accordingly, the air for drying clothes flows into the drum 10 from the rear of the drum 10, and is discharged forward from the drum 10.

FIG. 2 is a schematic plan view showing components of the drying machine shown in FIG. 1, which are disposed on a base 70 of the drying machine. The drum 10 and the heater 60, which are not directly mounted on the base 70, may be omitted from FIG. 2. Based on the base 70 (shown in FIG. 2), the upper side may correspond to the rear side of the drying machine, and the lower side may correspond to the front side of the drying machine.

Based on the base 70 (of FIG. 2), the condenser 40 is disposed at the left side, and the cooling fan 45, a motor 55 and the drying fan 50 are disposed at the right side. The motor 55 may drive the drying fan 50.

The drying fan 50 may be disposed in front of the drying machine and under the drum 10. In this example, the drying fan 50 may be disposed between the filter 30 and the condenser 40, unlike the arrangement shown in FIG. 1. In FIG. 2, since the drying fan 50 is disposed in front of the drum 10 and draws air into the drum 10, the drying machine may be referred to as a suction-type drying machine. In other words, the drying machine may be classified as the suction-type drying machine and/or the blower-type drying machine based on a positional relationship between the drum 10 and the drying fan 50, (i.e., depending on whether the drying fan 50 is disposed before or behind the drum 10).

The flow of air may now be described with reference to FIGS. 1 and 2.

The air, which has flowed into the drum 10, is discharged outward through the front of the drum 10, and flows downwards into the condenser 40. After the air is discharged from the condenser 40, the air rises and flows into the drum 10 through the rear of the drum 10. For purpose of upward and downward movement of the air, additional ducts may be provided. The additional ducts may be coupled to the drum 10 and the base 70 so as to constitute the complete air circulation unit 20.

External air may flow into the drying machine through the cooling channel 46 from the rear of the drying machine, and the air may be supplied to the condenser 40. The external air, which is supplied to the condenser 40, may exchange heat with the circulating air in the condenser, and may then be discharged laterally from the drying machine. In other words, by activation of the cooling fan 45, the external air flows into the condenser 40 through the cooling channel 46, and is then discharged therefrom. In order to improve efficiency of heat exchange, the flowing direction of the circulating air in the condenser 40 may be perpendicular to the flowing direction of the external air.

FIG. 3 is a schematic conceptual view showing an example of a heat pump-type drying machine. Other arrangements and configurations may also be provided.

As shown in FIG. 3, the heat pump-type drying machine may include the drum 10 and the air circulating unit 20 for circulating air through the drum 10. The air, which is discharged through the air circulating unit 20 from the drum 10, may again flow into the drum 10, after being subjected to condensation and heating procedures. Consequently, the air is circulated through the air circulating unit 20. The drying fan 50 is provided for circulating air. The drying fan 50 is provided at the air circulating unit 20 to generate air flow.

In order to dry clothes in the drum 10, air is heated and cooled by a heat pump system 80. The heat pump system 80 is a kind of refrigerating cycle that uses refrigerant. The heat pump system 80 may include a refrigerant pipe 82, an evaporation heat exchanger 81, a compressor 83, a condensation heat exchanger 84 and an expansion member 85.

More specifically, refrigerant may be circulated in such a manner as to flow (in this order) through the refrigerant pipe 82, the evaporation heat exchanger 81, the compressor 83, the condensation heat exchanger 84 and the expansion member 85.

The refrigerant in the evaporation heat exchanger 81 may absorb heat and thus evaporate. Accordingly, the evaporation heat exchanger 81 may cool circulating air and thus condense moisture by heat exchange between the refrigerant and the circulating air. Accordingly, the evaporation heat exchanger 81 may be considered to be a condenser corresponding to the condenser 40 of the drying machine in terms of circulation of air.

The refrigerant in the condensation heat exchanger 84 may be condensed while releasing heat. Accordingly, the condensation heat exchanger 84 may heat the circulating air through heat exchange between the refrigerant and the circulating air. Accordingly, the condensation heat exchanger 84 may be a heater corresponding to the heater 60 of the heater-type drying machine in terms of circulating air.

Therefore, procedures of condensing and heating the circulating air may be implemented through the heat pump system 80, and the circulating air may flow into the drum 10. The filter 30 may remove extraneous substances such as lint from the air. The filter 30 may be provided between the drum 10 and the evaporation heat exchanger 81.

Based on the drum 10 (of FIG. 3), the right side may correspond to the front side of the drying machine, and the left side may correspond to the rear side of the drying machine. The drying machine shown in FIG. 3 may be constructed such that the drying fan 50 is disposed behind the drum 10. The drying machine may be referred to as a blower-type drying machine. However, the drying machine (of FIG. 4) may alternatively be a suction-type drying machine, as described above.

FIG. 4 is a schematic plan view showing components of the drying machine shown in FIG. 3, which are disposed on the base 70 of the drying machine. The drum 10, which is not directly mounted on the base 70, may be omitted from FIG. 4. Based on the base 70 (of FIG. 4), the upper side may correspond to the rear side of the drying machine, and the lower side may correspond to the front side of the drying machine.

Based on the base 70, the evaporation heat exchanger 81 and the condensation heat exchanger 84 are disposed at the left side, and the expansion valve 85, the compressor 83, the motor 55 and the drying fan 50 are disposed at the right side. The motor 55 may drive the drying fan 50.

The flow of air may now be described with reference to FIGS. 3 and 4.

The air in the drum 10 may be discharged forward from the drum 10 by suction force of the drying fan 50. The discharged air may flow down toward the evaporation heat exchanger 81 and the condensation heat exchanger 84. The air is heated and thus releases moisture while passing through the evaporation heat exchanger 81 and the condensation heat exchanger 84. Thereafter, the air rises and enters the rear (or rear side) of the drum 10.

Since the heat pump-type drying machine performs cooling and heating of air through the heat pump system 80, the cooling fan 45 or the cooling channel 46, which are in the heater-type drying machine, may be provided.

The heat pump-type drying machine may perform the same procedures of filtering, condensation and heating for circulating air as in the above-described heater-type drying machine. However, there are differences in manners of heating and condensing between the heat pump-type drying machine and the heater-type drying machine. The heater 50 and the condenser 40 of the heater-type drying machine may correspond to the condensation heat exchanger 84 and the evaporation heat exchanger 84, respectively. Since the heater 50 and the condensation heat exchanger 84 are constructed to heat circulating air, the heater 50 and the condensation heat exchanger 84 may be referred to as heating units.

As described above, air circulating units 20 for circulating air, including the drums 10, in the heater-type drying machine and the heat pump-type drying machine may be substantially identical to each other. Further, the air circulation unit 20 may be very similar to the drying mechanism.

However, there are differences in the detailed structure of the air circulating unit 20 between the heater-type drying machine and the heat pump-type drying machine. The structures of flow channels in the bases 70 may differ from each other due to difference(s) in the manners of heating and condensing. More specifically, since the flow channel, which constitutes a part of the air circulating unit 20, is formed in the base 70, different bases 70 may be used due to differences in the flow channel. This means that different bases 70 may have to be used due to the difference(s) in manners of heating and condensing, even if the drying machines have the same external dimensions.

Accordingly, when there is a need to manufacture both heat pump-type drying machine and heater-type drying machine, a problem may arise in that bases 70 having different structures suitable for the respective types of drying machines may have to be manufactured and managed.

Since the bases 70 have different structures, components mounted on the bases 70 may also have different structures. That is, components having different structures may have to be used even to fulfill the same function.

The drying fan 50 and the motor 55 for driving the drying fan 50 may be used in common for both drying machines. The components, which are fundamentally different in manners of heating and condensing, may differ from each other. For example, only the heater-type drying machine includes the condenser 40 and the cooling fan 45, and only the heat pump-type drying machine includes the heat pump system 80.

In addition to exclusive components, other components, that fulfill the same function but have different structures, may be used in the respective drying machines. Accordingly, structures of the base 70, the drying fan 50 and other components (such as a drying fan housing, a condensed water pump and a condensed water guide member) may vary in accordance with the kinds (or types) of drying machines.

For example, among the components that are directly or indirectly mounted on the base 70 of the drying machines, four (4) components (including the motor 55 and legs) may be used in common in both drying machines. Meanwhile, twelve (12) components, including the base 70, which are different from one another, may be used in only one kind of drying machine. In particular, although about seven (7) kinds of components fulfill the same respective functions in both kinds of drying machines, structures of the respective components may be different from each other in both kinds of drying machines.

Consequently, there may be a problem in that a number of components, which have to be managed in different manners in accordance with the type of drying machine, may increase and thereby increase production costs. Additionally, the increase in the number of different components may make the manufacture and after-sales service difficult.

In the example of a circulation-type drying machine, it is preferable to efficiently discharge condensed water. In other words, it is preferable to efficiently discharge condensed water, generated in the drying machine, from the air circulation unit 20.

Condensed water may be generated not only at the condenser but also in any region of the air circulation unit 20 due to a decrease in temperature after the drying machine is shut down. It may not be desirable for the condensed water to be reheated or to flow into the drum 10 or the heating unit.

Accordingly, there may be a high necessity to provide a structure for efficiently removing condensed water. This may be more urgent for the circulation-type drying machine, and may also be more urgent for the blower-type drying machine.

In the blower-type drying machine, condensed water in the drying fan housing may be directly supplied to the heater due to air flow. Noises may be thereby generated. Further, when a large amount of condensed water is directly supplied to the heater, reliability of the heater may deteriorate.

For at least these reasons, there may be a very high necessity to prevent condensed water from flowing into the drying fan housing and to prevent condensed water in the drying fan housing from being directly supplied to the heater.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to preferred embodiments, examples of which are illustrated in the accompanying drawings. Wherever possible, the same reference numbers may be used throughout the drawings to refer to the same or similar parts.

An embodiment may relate to a drying machine.

Figure 1:
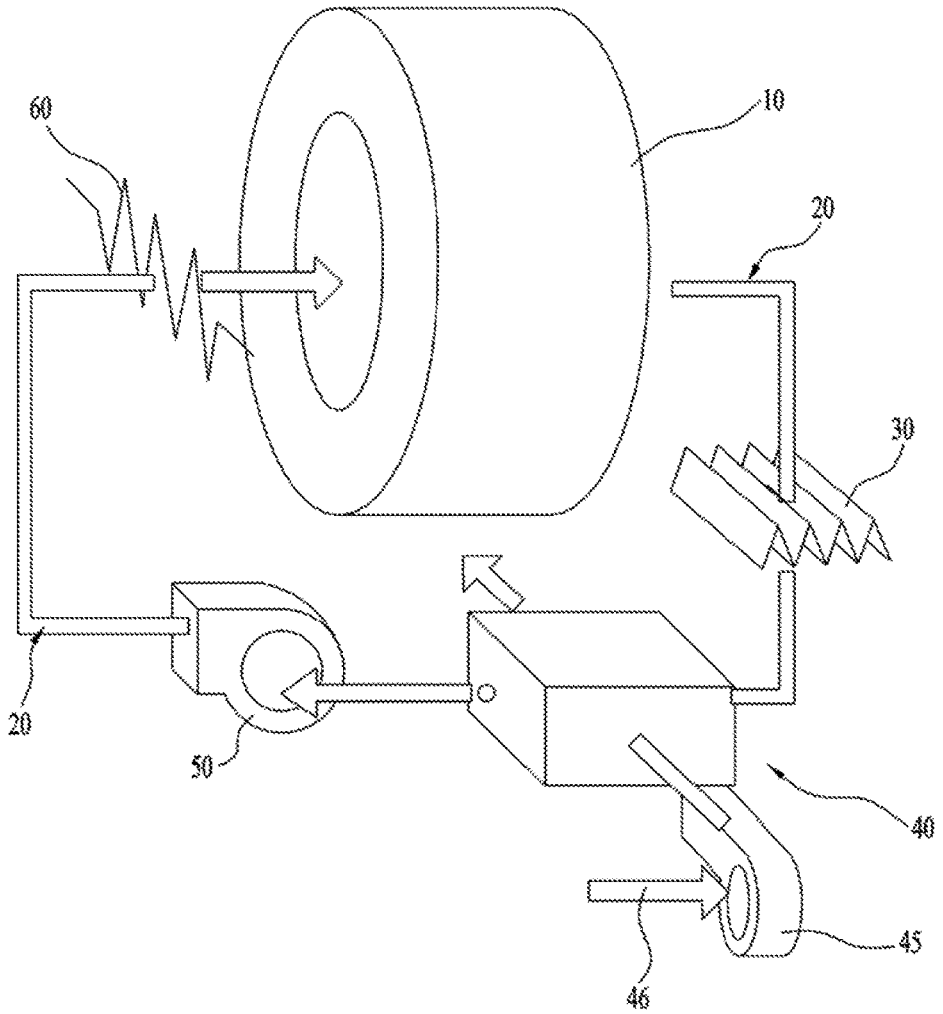
FIG. 1 is a schematic view showing an air circulation unit of a heater-type drying machine.
Figure 2:
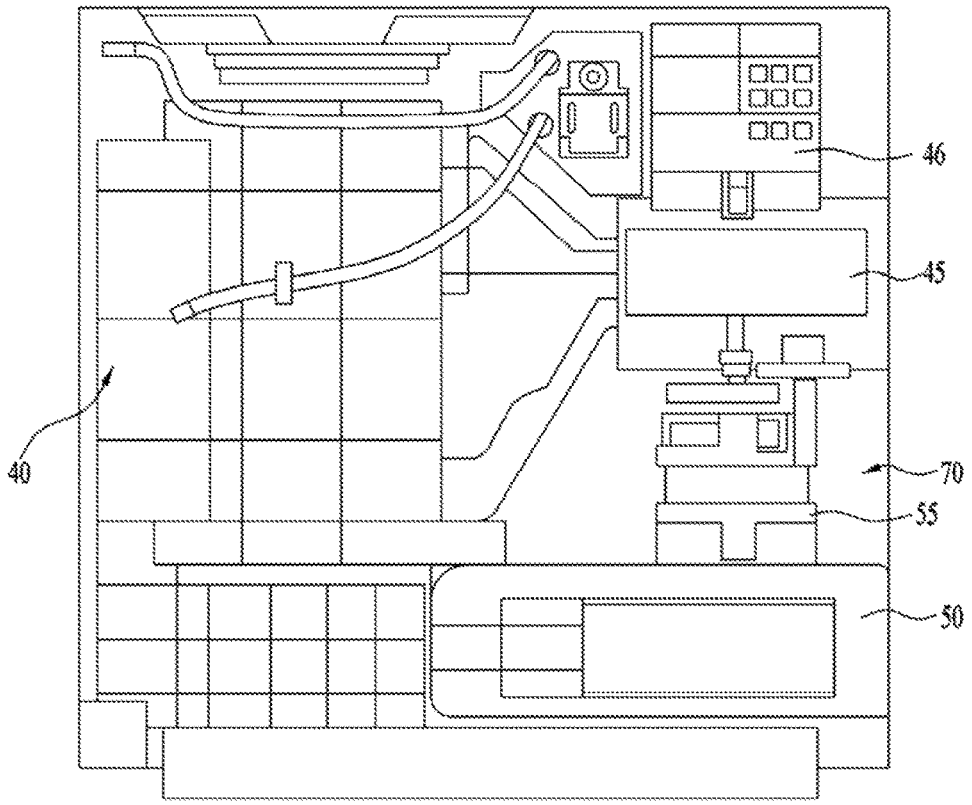
FIG. 2 is a plan view showing a base of the heater-type drying machine and associated peripheral components.
Figure 3:
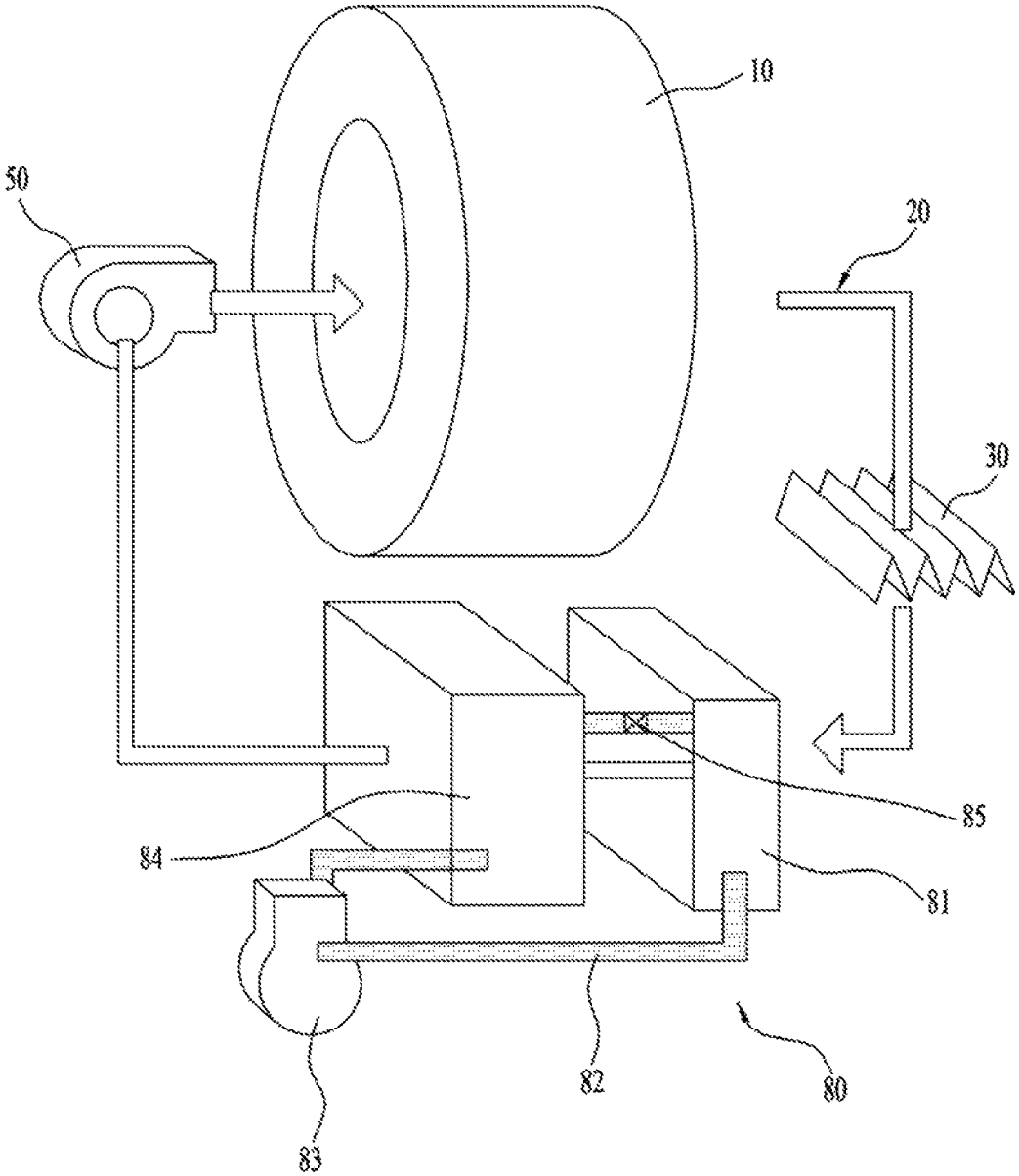
FIG. 3 is a schematic view showing an air circulation unit of a heat pump-type drying machine.
Figure 4:
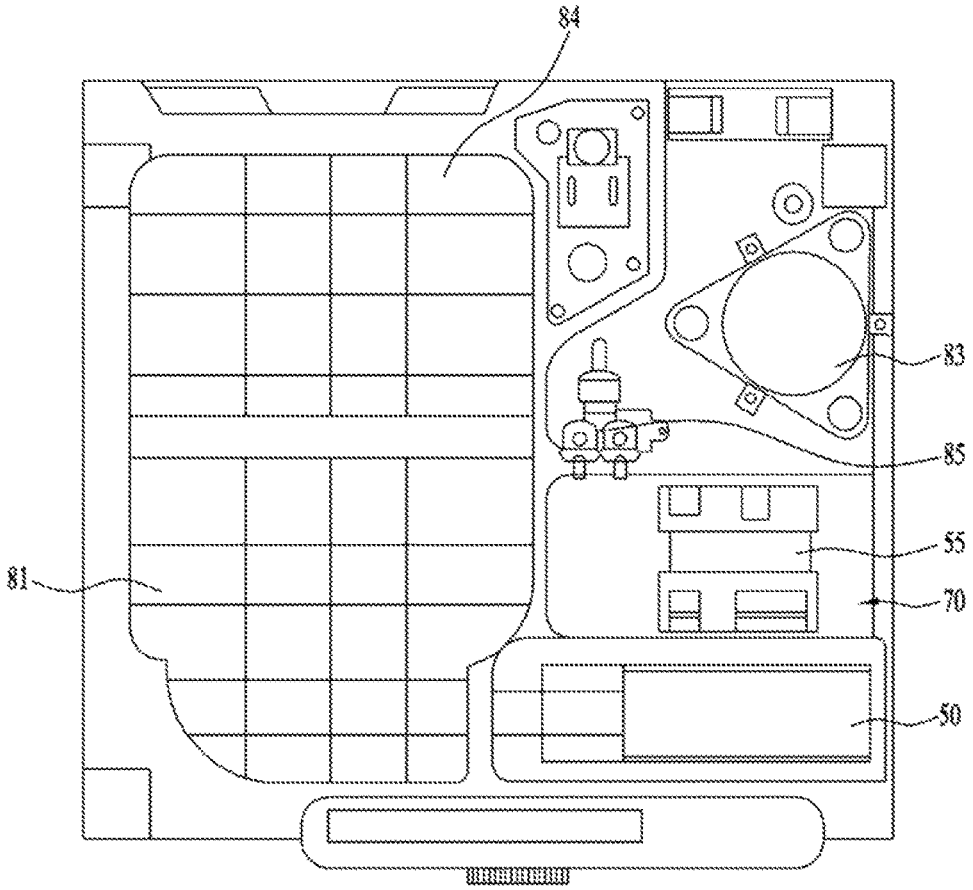
FIG. 4 is a plan view showing a base of the heat pump-type drying machine and associated peripheral components.

As shown in FIGS. 1 and 2, the drying machine according to an example embodiment may include the drum 10 for containing clothes to be dried, the air circulation unit 20 for circulating air through the drum 10, the drying fan 50 for the circulation of air, and the motor 55 for driving the drying fan 50.

The drying machine according to the example embodiment may further include the condenser for condensing moisture in the air introduced from the drum 10, the heating unit for heating the circulating air introduced from the condenser, the condensation duct (containing the condenser) and the base (including a condensation duct mount) on which the condensation duct is mounted.

The drying machine according to the example embodiment may include a cabinet defining an appearance of the drying machine. The base may be disposed under the drum to support the drum. The base may constitute a lowermost part of the drying machine, and the entire base may be supported by the ground through legs coupled thereto.

The drying machine according to the example embodiment may relate to a drying machine including a common base. Accordingly, the example embodiment may be described based on the base, and a detailed description of components (such as the cabinet and the drum) may be omitted.

The example embodiment may be described with reference to accompanying drawings.

The example embodiment may be described with reference to FIG. 5.

Figure 5:
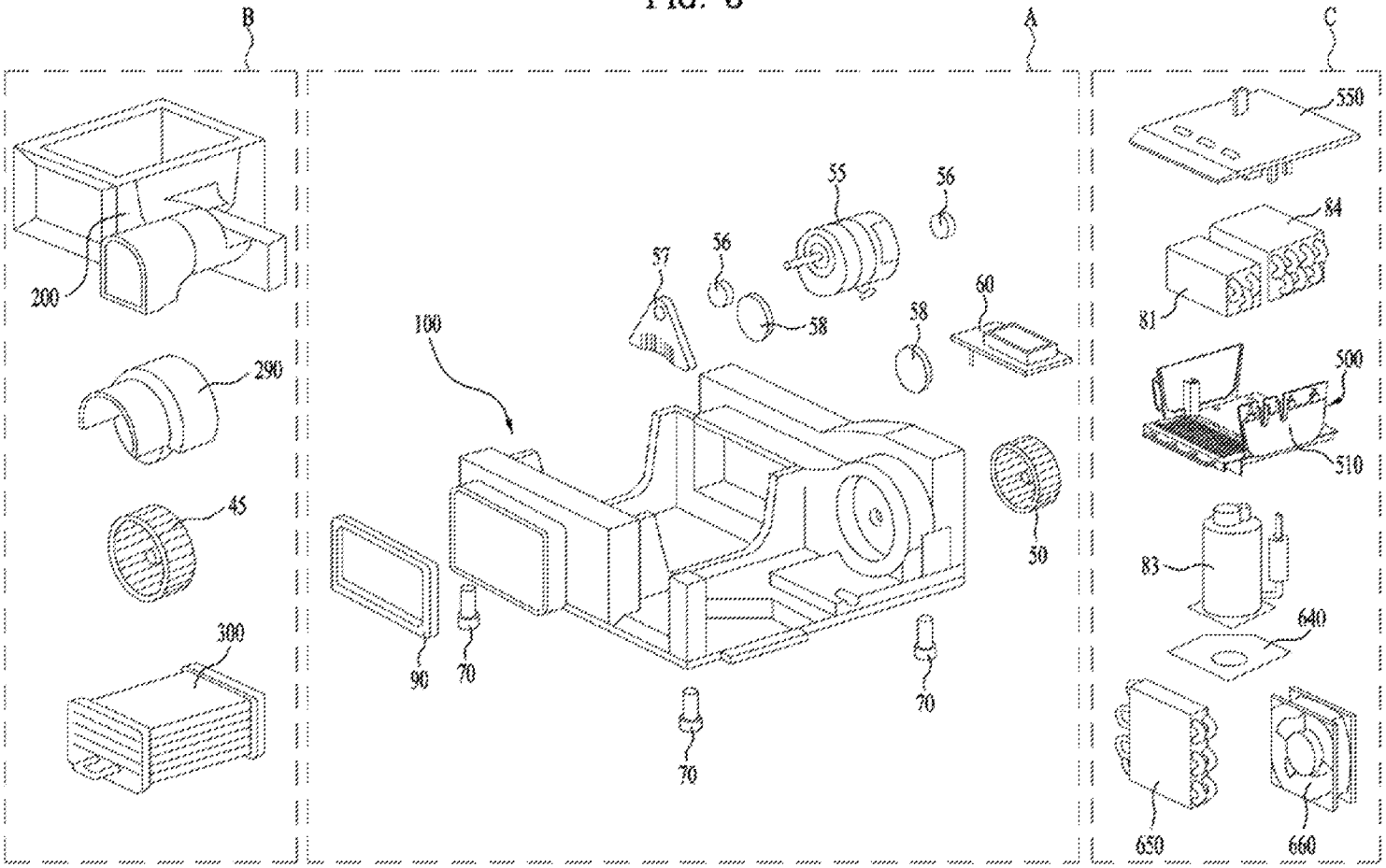
FIG. 5 is an exploded perspective view showing a base of a drying machine and associated peripheral components according to an example embodiment.

FIG. 5 is an exploded view showing common components (including a base 100 of the drying machine) and individual components in a heater-type drying machine and a heat pump-type drying machine. Only components that are directly or indirectly coupled to the base 100 are shown in FIG. 5. Other embodiments and configurations may also be provided.

Components in box A are components that are common to both the heater-type drying machine and the heat pump-type drying machine. Components in box B are components that are exclusive to the heater-type drying machine. Components in box C are components that are exclusive to the heat pump-type drying machine. Accordingly, components in box A and components in box B are coupled to each other to constitute the heater-type drying machine. Components in box A and components in box C are coupled to each other to constitute the heat pump-type drying machine.

The drying machine according to the example embodiment may increase a number of common components through the common base 100. Thus, the numbers of exclusive components of the heater-type drying machine and the heat pump-type drying machine may decrease.

Since the base 100 is the same in both types of drying machines, basic components mounted on the base 100 are considered common components. For example, components such as the drying fan 50, the motor 55 for driving the drying fan 50, a motor shaft coupling member 56, a roller 58 for rotatably supporting a drum, a motor shaft bracket 57, a condensed water detection assembly 65 (FIG. 17), a cover and legs 70 may be considered as common components.

Components in box B, in conjunction with common components, may constitute the heater-type drying machine. For example, components such as a condensation duct 200, the cooling fan 45, a cooling fan housing 290 and a condenser 300 may be components exclusive to the heater-type drying machine. The condenser 300 may be considered a heat exchanger for exchanging heat between circulating air and external air (i.e., an air heat exchanger). Since the condenser 300 is used in the heater-type drying machine, the condensation duct 200 may be considered a condensation duct of the heater-type drying machine (i.e., a heater-type condensation duct 200).

The heater 60, serving as a heating unit for heating air, may be an exclusive component of the heater-type drying machine. However, since the heater 60 may not be mounted on the base 100, the heater 60 is not shown in FIG. 5.

Components in box C, in conjunction with common components, may constitute the heat pump-type drying machine. For example, a condensation duct 500, an evaporation heat exchanger 81 (serving as a condenser for condensing moisture in circulating air), a condensation heat exchanger 84 for heating circulating air, a compressor 83 and a compressor support 640 may be exclusive components of the heat pump-type drying machine. Further, a second fan 660 and a second heat exchanger 650 may be included in the exclusive components of the heat pump-type drying machine. Components such as a refrigerant pipe 82 and an expansion unit 85, which constitute a refrigerating cycle, may also be exclusive components. The condensation duct 500 may include an upper condensation duct 550 and a lower condensation duct 510. The compressor support 640, the second evaporation heat exchanger 650 and the second fan 660 may also be components exclusive to the heat pump-type drying machine.

The evaporation heat exchanger 81 may also be considered to be a condenser. Further, the evaporation heat exchanger 81 may be considered to be a refrigerant heat exchanger because it cools refrigerant using air. Since the condenser is used in the heat pump-type drying machine, the condensation duct 500 may be considered a condensation duct of the heat pump-type drying machine (i.e., a heat pump-type condensation duct).

The base of the drying machine according to the example embodiment may be described with reference to FIG. 6.

Figure 6:
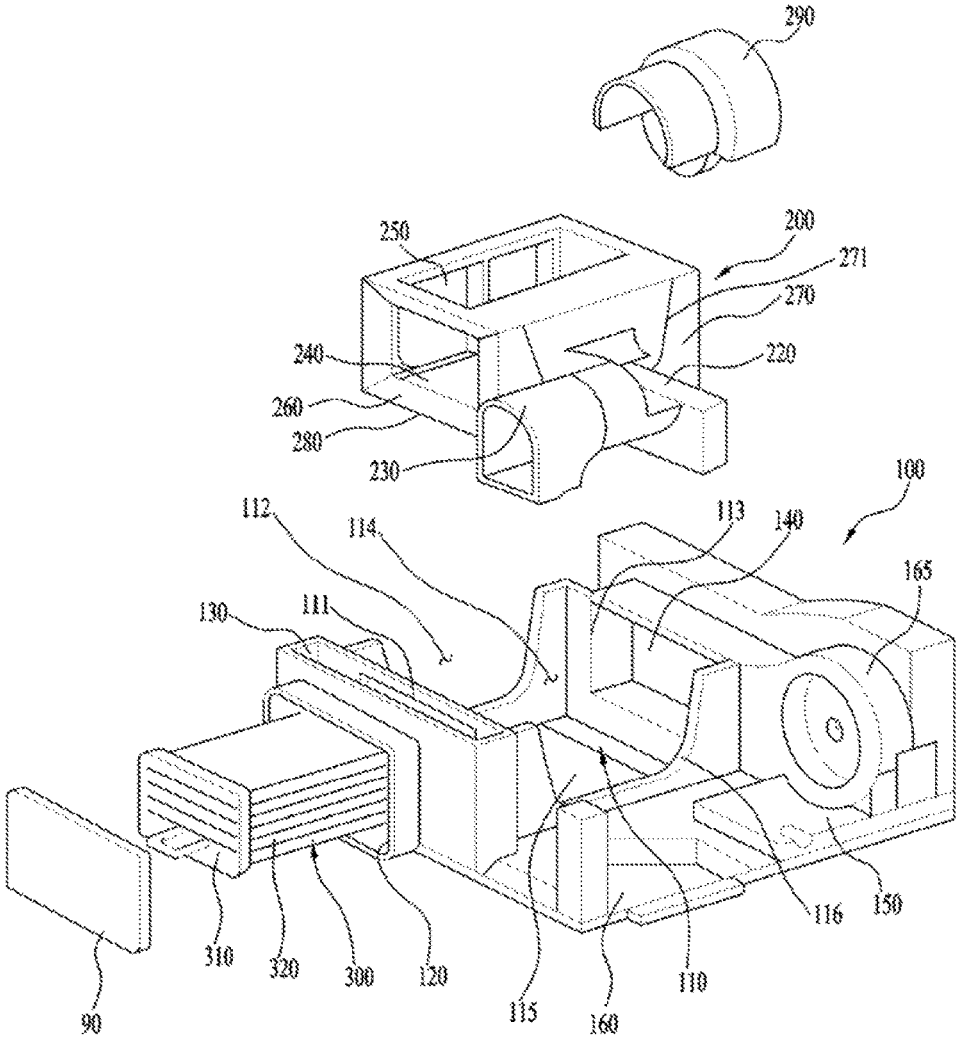
FIG. 6 is an exploded perspective view showing a common base and a heater-type drying machine mounted on the base.

FIG. 6 shows a separate view of the air heat exchanger-type condenser 300, the condensation duct 200 that accommodates the condenser 300, and the base 100. FIG. 6 shows an example in which the common base 100 is used in the heater-type drying machine.

The base 100 is provided with a condensation duct mount 110 on which the condensation duct 200 is mounted.

As a result of mounting the condensation duct 200 on the condensation duct mount 110, the condensation channel, which serves as part of the air circulating unit, is defined at the base 100.

The condenser 300 (shown in FIG. 6) is part of the air heat exchanger-type (i.e., the condenser of the heater-type drying machine). The condenser 300 is received in the condensation duct 200. The condensation duct 200 may be mounted on the base 100, and then the condenser 300 may be inserted into the condensation duct 200.

The condensation duct 200 may be constructed separately from and independently of the base 100, whereas the condensation duct mount 110 may be constructed together with the base 100 in an integral manner. Consequently, even if the condensation duct 200 varies in structure, the base 100 may be used in common.

An opening 120 may be provided at a front (or front end) of the base 100. The condensation duct 200 may also be provided at the front end thereof with an opening 260. The opening 120 (at the base 100) and the opening 260 (at the condensation duct 200) may be configured to communicate with each other. The openings 120 and 260 may be aligned with each other. Accordingly, the condenser 300 may be fitted into the condensation duct 200 through the openings 120 and 260 in the state in which the condensation duct 200 is mounted on the base 100.

After the condenser 300 is mounted on a condenser mount 240 (of the condensation duct 200), the opening 120 is closed by a cover 90.

A lint duct 130 may be provided at the front portion of the base 100. The lint duct 130 may constitute a part of the air circulation unit 20, and the air, which is discharged forward from the drum, may flow into the lint duct 130. The lint duct 130 may be provided with a filter. At least a portion of the lint duct 130 may be integrally formed with the base 100. The lint duct 130 may communicate with the condensation duct mount 110.

The condensation duct mount 110 may have a regular hexahedral shape or a rectangular parallelepiped shape. A front opening 111 may be provided at the front end. The lint duct 130 may communicate with the condensation duct mount 110 through the front opening 111.

A drying duct 140 may be provided at a rear portion of the base 100. The drying duct 140 may constitute a part of the air circulating unit 20, and may constitute a channel through which air is supplied to the rear side of the drum.

A rear opening 113 may be provided at the rear end of the condensation duct mount 110 so that the drying duct 140 may communicate with the condensation duct mount 110 through the rear opening 113.

An upper opening 114 may be provided at the upper end of the condensation duct mount 110 so that the condensation duct 200 is mounted on the condensation duct mount 110 from above through the upper opening 114. In other words, the upper opening 114 may be considered to be an insertion opening through which the condensation duct 200 is inserted into the condensation duct mount 110. When the condensation duct 200 is mounted on the condensation duct mount 110, the lint duct 130, the condensation duct 200 and the drying duct 140 may communicate with one another through the base 100. The air circulating unit may be sealed from the outside.

The high-temperature and high-humidity air, which has flowed into the condensation duct 200, may flow into the condenser 300 through a front inlet 310 of the condenser 300, and may then be discharged. The high-temperature and high-humidity air may exchange heat in the condenser 300. For purpose of the heat exchange, external air may flow into the condenser 300 through a side inlet 320, and may then be discharged. The circulating air may not contact the external air. More specifically, the circulating air may be intersected with the external air in the condenser 300, and may exchange heat through a heat exchange film.

For purpose of introduction of the external air, the condensation duct mount 110 may be provided with side openings 112. The side openings 112 may be provided at both lateral sides of the condensation duct mount 110 such that external air flows into the condensation duct mount 110 through the side openings 112 and is discharged through the side openings 112.

More specifically, the condensation duct mount 110 may include a lower mount 115 and side mounts 116. The side mounts 116 may be provided at both lateral sides. The condensation duct 200 may include two side walls 270 and a lower wall 280. The lower wall 280 (of the condensation duct 200) may be mounted on the lower mount 115 of the condensation duct mount 110. The side walls 270 (of the condensation duct 200) may be coupled to the side mounts 116 of the condensation duct mount 110. More specifically, the side mounts 116 may be fitted into mounting slots 271 formed in the side walls 270.

One of the side walls 270 (of the condensation duct 200) may be provided with an opening 250 so that external air flowing into the condensation duct 20 may be discharged to the outside. The opening 250 may communicate with one of the side openings 112 in the condensation duct mount 110. Accordingly, one of the side openings 112 is not closed by the condensation duct 200. The opening 250 may communicate with the side inlet 320 of the condenser 300, but the opening 250 may not communicate with the front inlet 310. Consequently, the circulating high-temperature and high-humidity air may not be discharged to the outside through the side opening 112.

The other one of the side walls 270 (of the condensation duct 200) may be provided with a cooling fan mount 220. The cooling fan mount 220 may communicate with the condenser 300 through an opening. In other words, the cooling fan mount 220 may communicate with the side inlet 320 of the condenser 300. The opening may be configured to have the same shape as the opening 250. However, the opening is not shown in FIG. 5 because the opening is hidden by the cooling fan mount 220.

The cooling fan 45 may be mounted on the cooling fan mount 220, and the cooling fan housing 290 may be coupled to the cooling fan mount 220. An external air guide 230 may be provided in front of the cooling fan mount 220. The external air guide 230 may be connected to an additional duct. The duct may guide external air to the external air guide 230 from the front of the drying machine.

When the cooling fan 45 (mounted on the cooling fan mount 220) is operated, external air flows into the condensation duct 200 through the external air guide 230 and the cooling fan mount 220. The other one of the side walls 270 (of the condensation duct 200) may close the side mount 116 of the condensation duct mount 110. However, since the other side wall 270 is also provided with an opening, external air may flow into the condensation duct 200 through the side mount 116 of the condensation duct mount 110.

Accordingly, the condensation duct mount 110 and the condensation duct 200 mounted thereon, may define a condensation channel. Additionally, the cooling channel may be defined through the side mount 116 and the side opening 112 in the condensation duct mount 110 to allow external air to be discharged therethrough. In other words, when the condensation duct 200 is mounted on the condensation duct mount 110, both the condensation channel and the cooling channel are defined. More particularly, based on shape and positional relationship between the condensation duct 200 and the condensation duct mount 110, the circulating air may intersect with external air in the condensation duct 200.

The side openings 112 in the condensation duct mount 110 may define the cooling channel. In other words, when the condensation duct 200 is mounted on the condensation duct mount 110, the cooling channel may be defined through the side openings 112.

As shown in FIG. 6, the side mounts 116 or the side openings 112 may be configured to have an inverted trapezoidal shape in which a width of the lower side is smaller. The angles between the lower side and both lateral sides of the trapezoidal shape may be the same. The angles between the lower side and both lateral sides of the trapezoidal shape may exceed 90 degrees, but may be equal to or less than 105 degrees.

Assuming that a length between the front and rear ends of the condensation duct mount 110 is fixed, increasing the angle between the lower side and the lateral side of the trapezoidal shape may decrease the length of the lower side of the trapezoidal shape. Accordingly, the angle between the lower side and the lateral side of the trapezoidal shape may be only limitedly increased while maintaining the trapezoidal shape. This may be because the side openings 112 define the cooling channel, as described above. More particularly, as the angle is increased, the area of the passage through which external air flows into the condensation duct 200 and is discharged may inevitably be decreased. Reducing the area of the passage may mean that a sufficient amount of external air may not flow into the condensation duct 200 and may not be discharged. Additionally, the angle may be preferably smaller than 105 degrees, and preferably may be about 100 degrees.

The trapezoidal shape of the side mount 116 or the side opening 112 may make it easy to mount the condensation duct 200. This is because the condensation duct 200 may be easily mounted by virtue of the weight of the condensation duct 200. Further, since the coupling force between the two components is always maintained by virtue of the weight of the condensation duct 200, it may be advantageous in terms of sealing.

Figure 7:
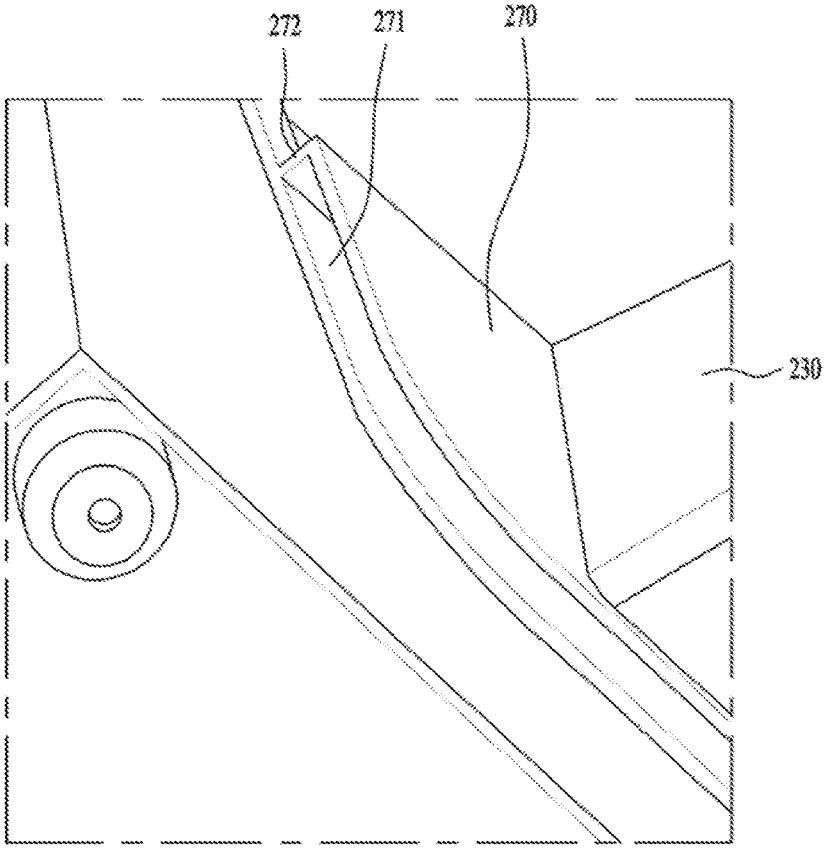
FIG. 7 is an enlarged view showing a mounting structure for the condensation duct shown in FIG. 6.
Figure 8:
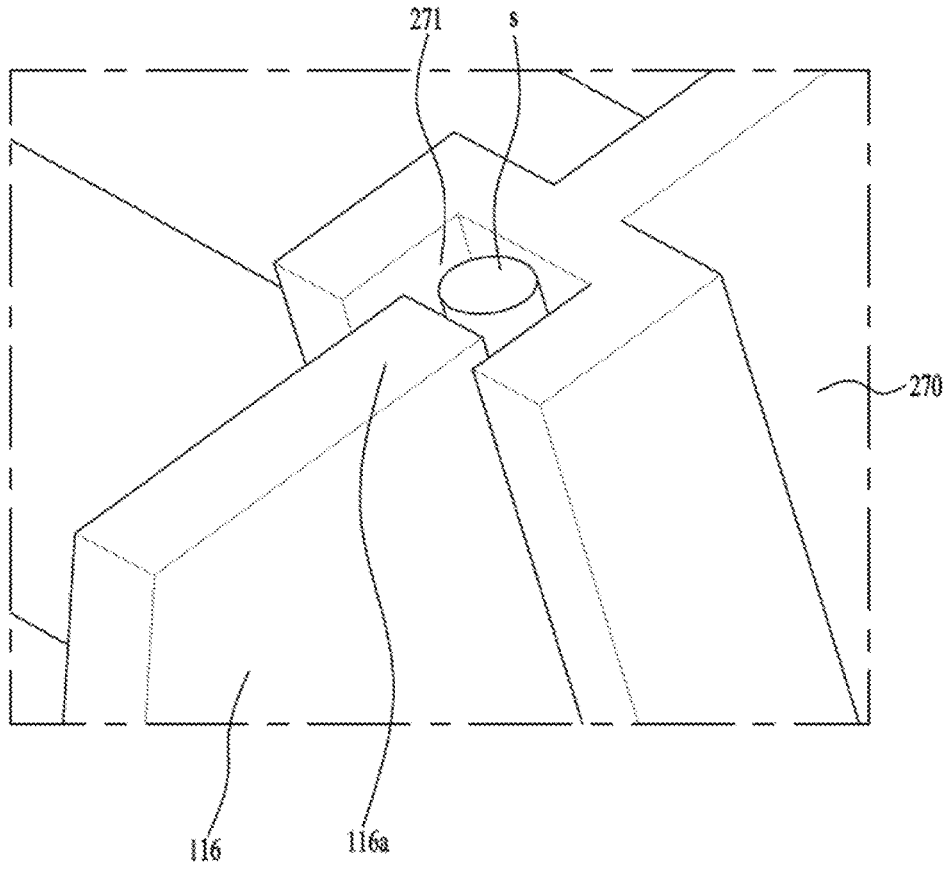
FIG. 8 is an enlarged view showing a coupling portion between the condensation duct and the condensation duct mount of the base of the heater-type drying machine.

FIG. 7 is an enlarged view showing a portion of the side wall 270 of the condensation duct 200. FIG. 8 is an enlarged view showing a coupling portion at which the side wall 270 (of the condensation duct 200) and the side mount 116 (of the condensation duct mount 110) are coupled to each other. Other embodiments and configurations may also be provided.

A mounting slot 271 and a mounting rib 116*a* may be provided between the side wall 270 (of the condensation duct 200) and the side mount 116 (of the condensation duct mount 110) at one lateral side of the base 100. The mounting rib 116*a* may be the side mount 116 itself of the condensation duct mount 110. The mounting rib 116*a* may be slidably fitted into the mounting slot 271 and coupled thereto. The mounting slot 271 and the mounting rib 116*a* may also be provided on the other lateral side of the base 100. The mounting arrangement (including the mounting slot and the mounting rib) may also preferably be provided to the condensation duct of the heat pump-type drying machine, which may be described below.

An example in which the mounting slot 271 is provided to the side wall 270 and the mounting rib 116*a* is provided to the side mount 116 is shown in FIGS. 7 and 8. Unlike the arrangement shown in the drawings, relative positions of the mounting slot 271 and the mounting rib 116*a* may be reversed. A sealing member S may be provided between the mounting slot 271 and the mounting rib 116*a*. The load of the condensation duct 200 may be applied to the sealing member S. Further, the load of the condenser 300 may be applied to the sealing member S through the condensation duct 200. Consequently, the seal between the condensation duct 200 and the condensation duct mount 110 may be reliably maintained.

The mounting slot 271 may be provided with a stopper 272. The stopper 272 may be provided in order to limit the coupling position of the condensation duct 200 with respect to the condensation duct mount 110. The condensation duct 200 may drop by its own weight until the mounting rib 116*a* contacts the stopper 272. Accordingly, the coupling position between the condensation duct 200 and the condensation duct mount 110 may be precisely determined.

The coupling structure between the condensation duct mount 110 and the side wall 270 (of the condensation duct 200) may be identically applied to both lateral sides of the base 100. For example, the mounting slot 271 and the mounting rib 116*a* may be identically and symmetrically provided at both lateral sides of the base 100.

The example in which the condensation duct 200, which accommodates the air heat exchanger-type condenser 300, is coupled to the common base 100 has been described with reference to FIGS. 6 to 8.

An example in which the condensation duct 500, which accommodates the refrigerant heat exchanger-type condenser 81, is coupled to the common base 100 may now be described with reference to FIGS. 9 and 10.

Figure 9:
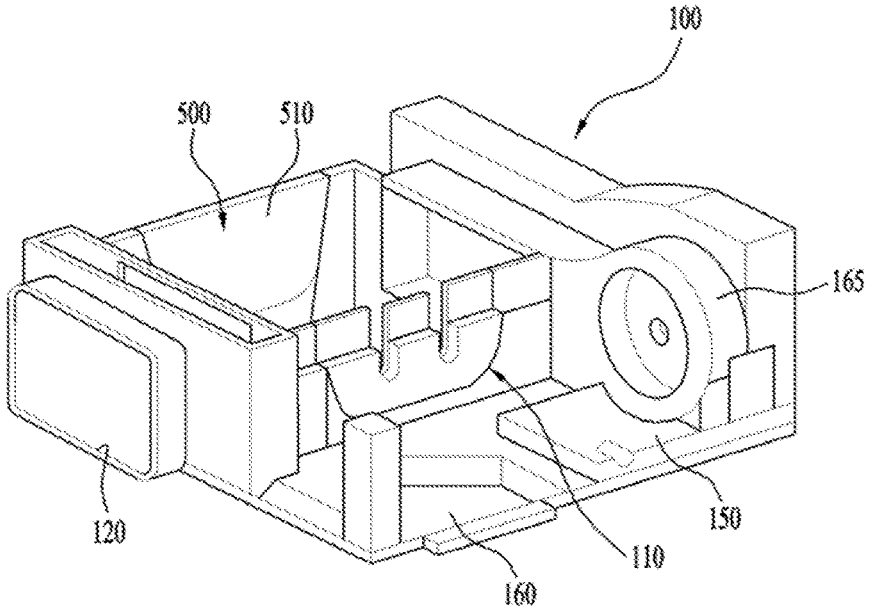
FIG. 9 is an assembled perspective view showing a common base and a condensation duct of the heat pump-type drying machine mounted on the base.
Figure 10:
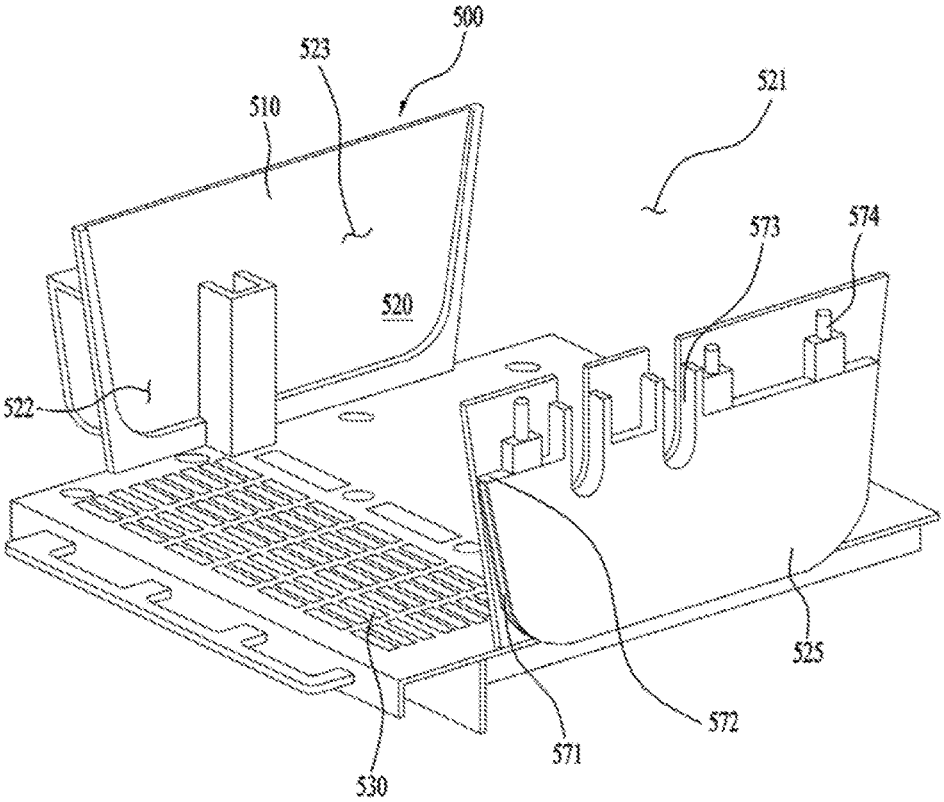
FIG. 10 is a perspective view showing the condensation duct, (i.e., the lower condensation duct) of the heat pump-type drying machine shown in FIG. 6.

As shown in FIG. 9, the common base 100 may be identical to the above-described common base 100 on which the air heat exchanger-type condenser 300 is mounted. In other words, the base 100, constituted by a single body, is the same in both types. The base 100 may be constructed by preparing a plurality of segments and coupling the segments to each other through coupling means (such as thermal fusion).

The base 100, according to this example embodiment, may include the condensation duct mount 110. The type of the drying machine may change based on which condensation duct is mounted on the condensation duct mount 110. More specifically, different types of condensation ducts may be mounted on the same condensation duct mount 110, and thus the type of drying machine may change by changing the condensation duct to be mounted. Even if different condensation ducts are applied, structures of the portions of the condensation ducts that are coupled to the condensation duct mount 110 may be the same.

FIG. 9 illustrates an example in which the condensation duct 500 (of the heat pump-type drying machine) is mounted on the condensation duct mount 110. FIG. 10 specifically illustrates the condensation duct 500. Other embodiments and configurations may also be provided.

More specifically, the condensation duct 500 may include the lower condensation duct 510, and the lower condensation duct 510 may be mounted on the condensation duct mount 110. The condensation duct 500 may include the upper condensation duct 550 (shown in FIG. 5). The upper condensation duct 500 may be coupled to the lower condensation duct 510 to define a space for accommodating the condenser.

When the condensation duct 500 is mounted on the condensation duct mount 110, the condensation duct 500 may communicate with the lint duct 130 and the drying duct 140. The condensation duct 500 may specifically accommodate the evaporation heat exchanger 81 and the condensation heat exchanger 84. In other words, the evaporation heat exchanger and the condensation heat exchanger may be mounted on a mounting seat 520 provided in the condensation duct 500. The evaporation heat exchanger 81 may cool circulating air so as to condense the moisture contained in the circulating air. Accordingly, the evaporation heat exchanger may be considered to be the condenser of the heat pump-type drying machine. The condensation heat exchanger 84 may heat the air from which moisture is removed. Accordingly, the evaporation heat exchanger 84 may be the heating unit of the heat pump-type drying machine.

The condensation duct 500, and more specifically, the lower condensation duct 510, may be provided with an upper opening 523, a front opening 522 and a rear opening 521. The upper opening 523 may be closed by the upper condensation duct 550. The evaporation, heat exchanger 81 may be received in the condensation duct 500 near the front opening 522, and the condensation heat exchanger 84 may be received in the condensation duct 500 near the rear opening 523. The evaporation heat exchanger 81 and the condensation heat exchanger 84 may be mounted in the mounting seat 520 in the state of being isolated from each other by means of a partition.

The mounting seat 520 may be provided with a water-discharging hole 530. The water-discharging hole 530 may be formed in a front part of the mounting seat 520. The water-discharging hole 530 may include a plurality of water-discharging holes.

The condensed water, generated by the evaporation heat exchanger 81, may be discharged downwards through the water-discharging holes 530, and may flow into a sump 66 (see FIG. 12) through a water-discharging channel formed in the bottom surface of the base 100. The sump 66 may include a condensed water detection assembly 65.

The condensation duct 500 may include two side walls 525. The two side walls 525 may be provided at the lower condensation duct 510. Each mounting side wall 525 may be provided with a mounting slot 571. The mounting slot 571 may be configured to have the same shape and size as the mounting slot 571 of the condensation duct 200 of the heater-type drying machine, described above. Accordingly, the condensation duct 500 may be mounted on the same condensation duct mount 110. The condensation duct 500 may also be provided with a stopper 572.

The two side walls 525 may be configured to close the two side faces of the condensation duct mount 110, because the heat pump-type drying machine may not need to have the cooling channel. Accordingly, the side openings 112 in the heat pump-type drying machine, which define the cooling channel the heater-type drying machine, may be closed by the two side walls 525 of the condensation duct 500.

The coupling structure between the condensation duct mount 110 and the condensation duct 500 may be identical to the structure of the above-described heater-type drying machine.

One of the two side walls 525 may include a slot 573. The slot 573 may receive a refrigerant tube. More specifically, the slot 573 may expose the refrigerant tube, provided at the evaporation heat exchanger 81 or the condensation heat exchanger 84, to the outside. Based on the slot 573, the heat exchanger may be firmly secured in the condensation duct. Further, the size of the condensation duct may be prevented from increasing due to the refrigerant tube.

Each of the two side walls 525 may be provided with a plurality of coupling members 574 for coupling the upper condensation duct 550 to the side wall 525. The coupling members 574 may be variously modified.

A motor mount 150 may be provided at a lateral side of the base 100. A drying fan mount 165 may be provided behind the motor mount 150. Further, the base 100 may be provided before the motor mount 150 with a selective mount 160.

The same motor and the same drying fan may be mounted on the motor mount 150 and the drying fan mount 165, respectively, irrespective of the type of drying machine. Accordingly, shapes of the motor mount 150 and the drying fan mount 165 may not be, changed, irrespective of the type of, drying machine.

The compressor 83 or the cooling fan mount 230 may be mounted on the selective mount 160. More specifically, the compressor 83 may be mounted on the selective mount 160 for the heat pump-type drying machine, and the cooling fan mount 230 may be mounted on the selective mount 160 for the heater-type drying machine.

Therefore, the same base may be used for both heat pump-type drying machines and heater-type drying machines.

An embodiment of the drying machine having a structure for discharging condensed water may be described in detail. This embodiment may be constructed independently of or collectively with the preceding embodiment. Accordingly, components that may also be used in common in the preceding embodiment may be designated by the same reference numerals, and detailed descriptions thereof may be omitted.

The discharge of condensed water may be critical in the drying machine that condenses moisture in the circulating air. This may have an influence on efficiency of the drying machine and reliability and durability of products. More specifically, one may minimize the flow of condensed water generated from the air circulating unit, into the drum or the heater while efficiently discharging condensed water generated from the condenser to the sump.

The condensed water may not only be generated from the condenser during operation of the drying machine, but may also be naturally generated by the temperature drop after the drying machine is shut down. Condensed water from the later source may be collected in the air circulating unit, and may flow into the drum or the heater during subsequent operation of the drying machine. The removal of the condensed water may thus require additional energy, thereby deteriorating efficiency of the drying machine.

In the above-described suction-type drying machine, the air discharged from the drum may flow into the drying fan because the drying fan draws air from the heating unit or the heater. Consequently, there may be a low possibility that condensed water generated near the drying fan will flow into the heating unit or the heater. In the blower-type drying machine, there may be a high possibility that condensed water generated near the drying fan is supplied to the heater because the drying fan blows air toward the heater.

Accordingly, although condensed water is removed in both the suction-type drying machine and the blower-type drying machine, it may be more critical to remove condensed water in the blower-type drying machine. The preceding embodiment describes the common base is used in the heater-type drying machine and the heat pump-type drying machine. Accordingly, the drying machine using the common base (and more particularly the heater-type drying machine) may be a blower-type drying machine. Therefore, condensed water may be removed in the blower-type drying machine, which is the heater-type drying machine.

Figure 11:
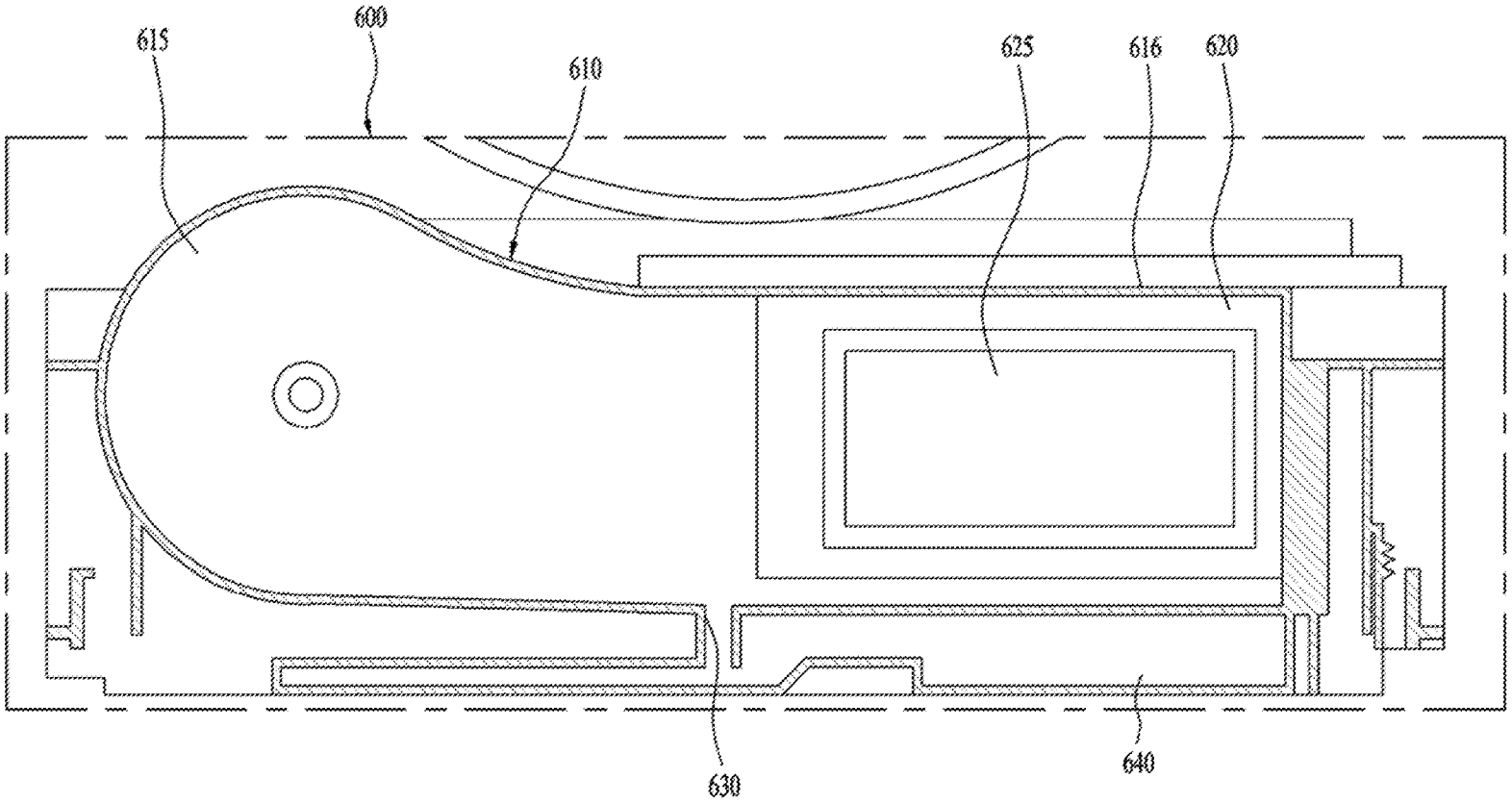
FIG. 11 is a cross-sectional view showing a condensed water-discharging structure of the base of a drying machine according to an example arrangement.

FIG. 11 illustrates a structure for discharging condensed water in a base of a drying machine according to an example arrangement. Other arrangements and configurations may also be provided.

The base 600 of the drying machine may be provided at a rear part thereof with a first drying duct 610. The first drying duct 610 may be provided between a condensation duct 620 and a second drying duct. The condensation duct 620 may contain a condenser 625 therein. As the drying machine operates, condensed water generated from the condenser 625 flows into a sump 640 through a water-discharging channel. The water-discharging channel may be provided at a lower portion of the condenser 620. The water-discharging channel and the sump may be integrally formed with the base.

One end 616 of the first drying duct 610 may be connected to the condensation duct 620, and the other end of the first drying duct 610 may constitute a drying fan housing connector 615. The drying fan housing connector 615 may be connected to a drying fan housing. When the drying fan provided at the drying fan housing is activated, the drying fan may draw air from the condensation duct 620. Consequently, condensed water in the condensation duct 620 may flow into the drying fan housing through the drying fan housing connector 615. The condensed water may be supplied to a heater, which is provided at the second drying duct, through the drying fan housing 615.

In the drying machine according to the example arrangement, a water-discharging hole 630 is formed in a bottom of the first drying duct 610 in order to discharge the condensed water. More specifically, since the water-discharging hole 630 is formed in the bottom of the first drying duct 610, upon activation of the drying fan, the condensed water flows along the bottom surface of the first drying duct 610 and flows into the water-discharging hole 630.

However, the water-discharging hole 630 may have a problem in that condensed water may be insufficiently discharged. This is because most of the condensed water is drawn into the drying fan because of the high suction pressure of the drying fan. Additionally, since a difference between the height of the inlet in the water-discharging hole 630 and the height of the sump 640 is not very large, the structure may cause a problem in that condensed water is discharged from the water-discharging hole 630.

Accordingly, a drying machine may provide a structure capable of discharging condensed water more efficiently. In particular, the condensed water-discharging structure may be integrally formed with the base, thereby offering a drying machine capable of being easily assembled. This embodiment may be constructed in conjunction with the preceding embodiment so as to provide a drying machine having the condensed water-discharging structure capable or being used in common regardless of the type of drying machine.

According to this embodiment, a drying machine may be provided having a condensed water-discharging structure capable of efficiently preventing condensed water generated from the air circulating unit from flowing into the drum along the air circulating unit.

An embodiment of the condensed water-discharging structure may be described with reference to FIGS. 12 to 15. Other embodiments and configurations may also be provided.

Figure 12:
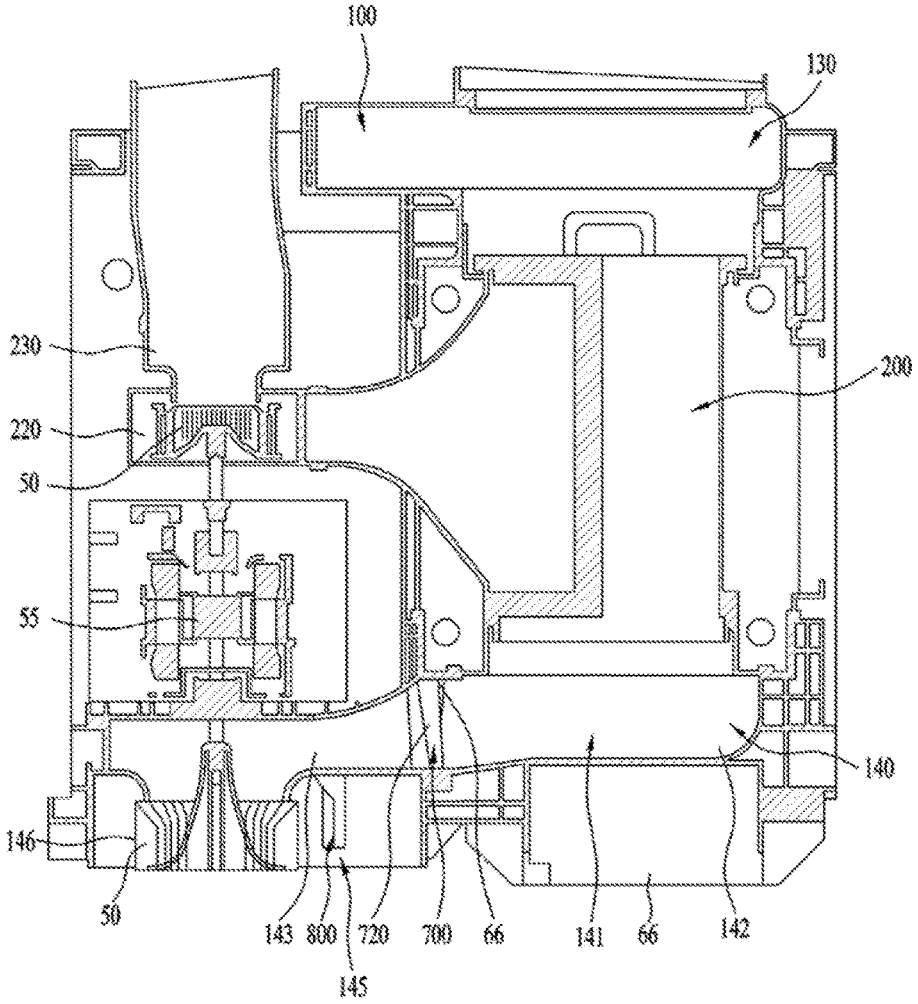
FIG. 12 is a plan cross-sectional view showing a base including a condensed water-discharging structure of a drying machine and associated peripheral components according to an example embodiment.

As shown in FIG. 12, the condensed water-discharging structure may be applied to the heater-type drying machine including the above-described common base. Therefore, descriptions of the common components may be omitted.

The drying duct 140 may include a first drying duct 141 and a second drying duct 145. When the first drying duct 141 is positioned between the condensation duct 200 and the second drying duct 145, the second drying duct 145 is positioned between the first drying duct 141 and the drum 10.

The first drying duct 141 is connected between the rear end of the condensation duct 200 and the drying fan housing 146 accommodating the drying fan. Accordingly, the first drying duct 141 includes a condensation duct connector 142 (connected to the condensation duct 200) and a drying fan housing connector 143 (connected to the drying fan housing 146).

The first drying duct 141 may extend horizontally to the drying fan housing 146 from the condensation duct 130 in the lower part of the drying machine. The first drying duct 141 may be disposed behind the base 100, and may be integrally formed with the base 100.

As the drying fan 50 operates, the drying fan 50 may draw air. Based on suction pressure, condensed water as well as circulating air may flow into the first drying duct 141 from the condensation duct 130. The condensed water may also flow into the drying fan housing 146.

Accordingly, the condensed water-discharging structure 700 may be formed at the first drying duct 141.

The condensed water-discharging structure 700 may be disposed between the condensation duct connector 142 and the drying fan housing connector 143. More specifically, the condensed water-discharging structure 700 may be provided at the bottom surface of the first drying duct 141.

The condensed water-discharging structure 700 may include a first drying duct drain outlet 710, formed in a lower portion of the first drying duct 141, and an outer rib 720 at a side edge of the first drying duct drain outlet 710.

The outer rib 720 may be provided at the side edge of the first drying duct drain outlet 710 that is close to the drying fan housing 146 so as to extend upward. The outer rib 720 disposed at the side edge of the first drying duct drain outlet 710 that is positioned at the rear side in the direction in which air is introduced, and the outer rib 720 may be inclined upward and forward in the direction in which air is introduced.

As suction pressure increases, condensed water flowing along the bottom surface may flow over the first drying duct drain outlet 710. However, condensed water may not flow over the first drying duct drain outlet 710 based on the outer rib 720. In other words, condensed water may collide with the outer rib 720, and thus flow into the first drying duct drain outlet 710.

As shown in FIG. 12, the outer rib 720 may be oriented to be inclined when viewed in a plan view. The surface of the outer rib 720 may be disposed to be substantially perpendicular to the direction in which air flows. As shown, the drying fan housing 146 is spaced apart from the condensation duct 200 in the anteroposterior direction. Accordingly, air flows along the inclined line connecting a center of the condensation duct connector 141 with a center of the drying fan housing connector 143. Therefore, the outer rib 720 may be inclined to be perpendicular to the direction in which air flows.

The angle between the outer rib 720 and the bottom surface of the first drying duct 141 may be within a range of 25 to 35 degrees. If the angle exceeds this range, then air resistance may increase. On the other hand, if the angle is more acute than this range, then condensed water may flow over the outer rib 720.

Figure 13:
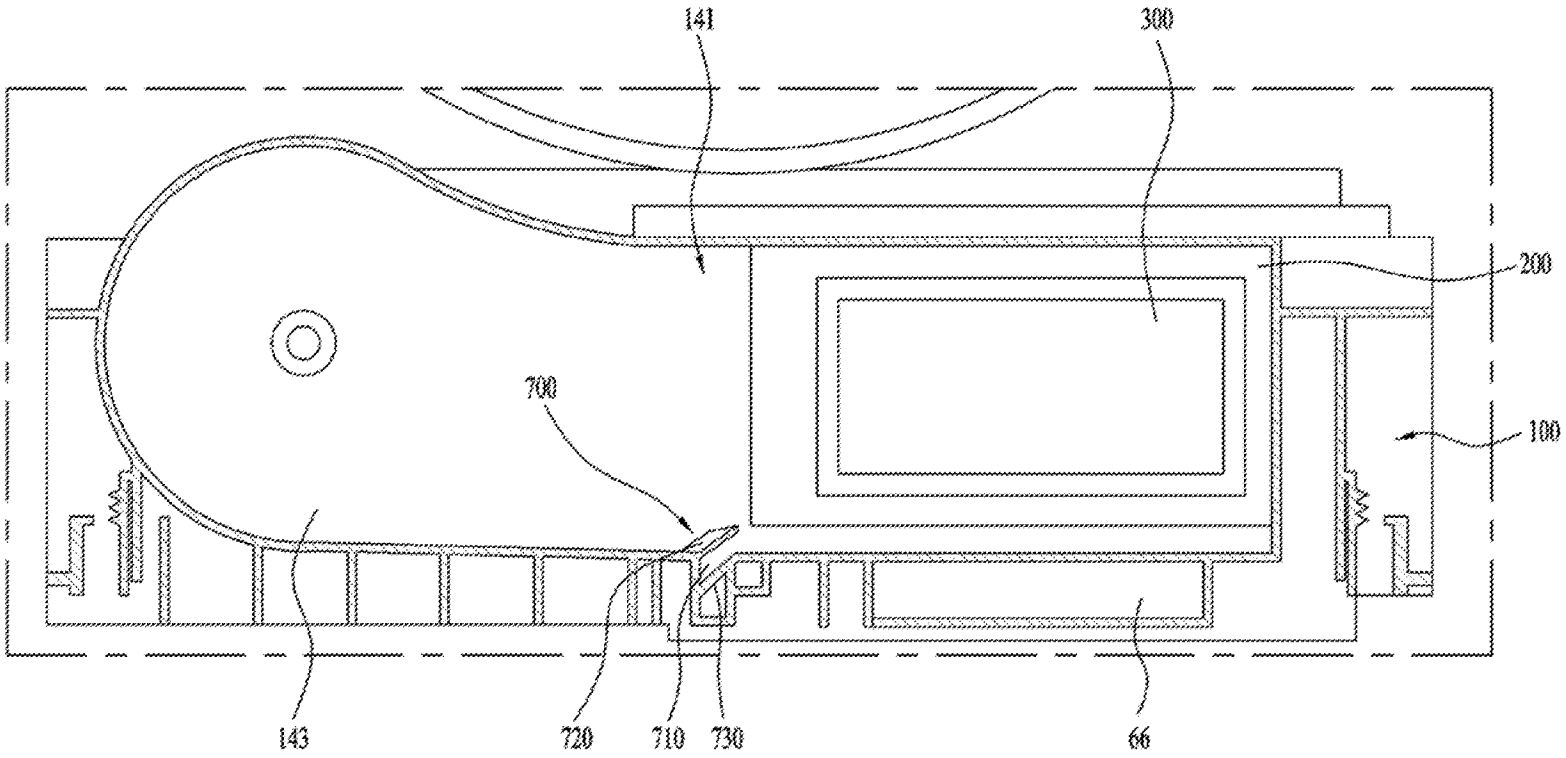
FIG. 13 is a cross-sectional view showing the condensed water-discharging structure shown in FIG. 12.
Figure 14:
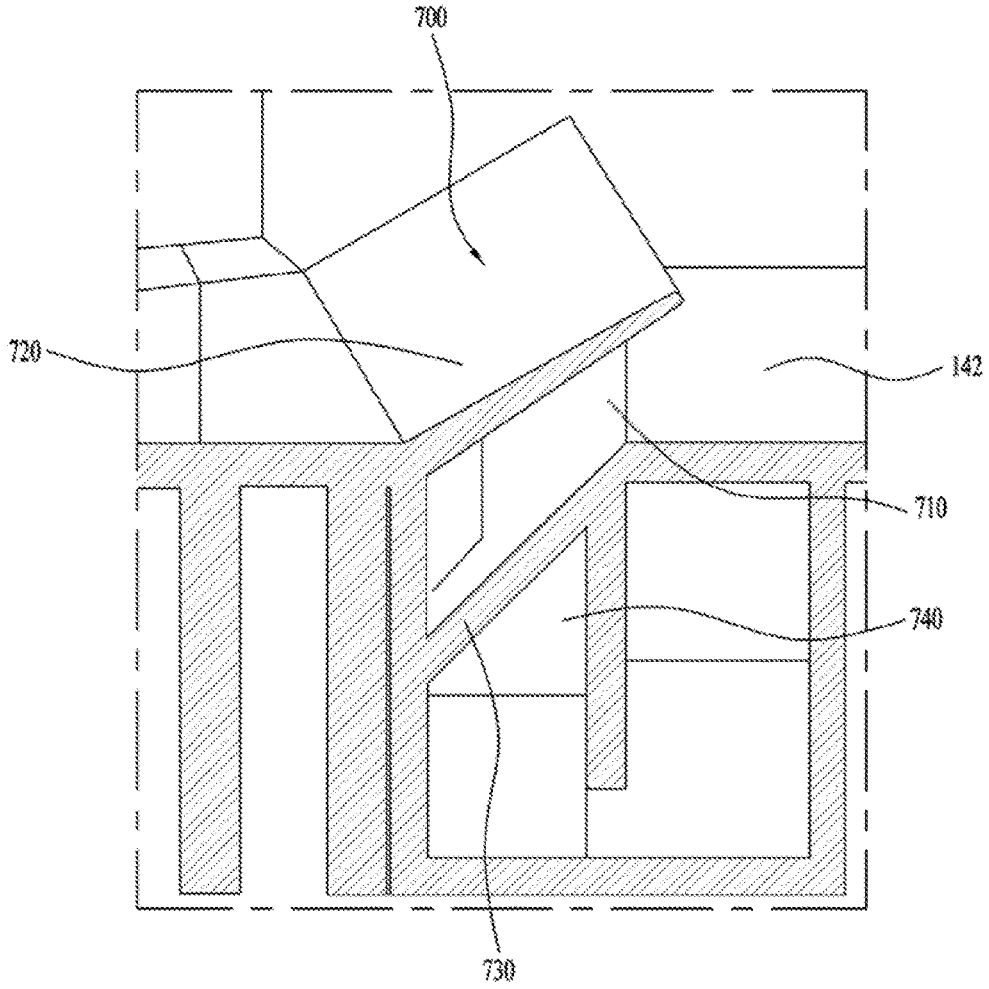
FIG. 14 is an enlarged cross-sectional view showing the condensed water-discharging structure shown in FIG. 13.

As shown in FIG. 13, the condensed water-discharging structure 700 may include an inner rib 730 to prevent condensed water from flowing back through the first drying duct drain outlet 710. Accordingly, the inner rib 730 may be provided at the side edge of the first drying duct drain outlet 710 that is close to the condensation duct 200 so as to extend downwards.

The inner rib 730 may be inclined downward and toward the drying fan housing. The angle between the inner rib 730 and the first drying duct 141 may be within a range of 130 to 140 degrees.

Therefore, the outer rib 720 may be positioned at the upper level of the first drying duct drain outlet 710 whereas the inner rib 730 may be positioned at the lower level of the first drying duct drain outlet 710. Consequently, condensed water may be prevented from flowing back while guiding the condensed water into the first drying duct drain outlet 710.

Due to positional relationship between the front end and the rear end of the first drying duct 141, a rate of airflow may vary along the anteroposterior width of the first drying duct 141. More specifically, the rate of airflow may be greater at the front part of the first drying duct 141 shown in FIG. 12 (i.e., the front part of the drying machine). Thus, a larger amount of condensed water may flow at the front part of the first drying duct 141 in the anteroposterior direction.

Accordingly, a transverse width of the first drying duct drain outlet 710 may vary along the longitudinal direction. More specifically, the transverse width of the first drying duct drain outlet 710 at the front end thereof may be greater than the transverse width of the first drying duct drain outlet 710 at the rear end thereof. In other words, the transverse width of the first drying duct drain outlet 710 at the front end thereof, over which condensed water has to flow, may be greater than the transverse width of the first drying duct drain outlet 710 at the rear end thereof, over which the condensed water has to flow.

The first drying duct drain outlet 710 may be formed along the entire anteroposterior length of the first drying duct 141. In other words, the first drying duct drain outlet 710 may be formed in the bottom of the first drying duct 141 along the entire anteroposterior length thereof. This may enable a larger amount of condensed water to flow into the first drying duct drain outlet 710.

The first drying duct drain outlet 710 may allow not only condensed water in the drying fan housing connector 143, but also condensed water that has flowed from the condensation duct 200 to flow thereinto. This is because condensed water may be naturally generated in the first drying duct 141 when the drying machine does not operate. Accordingly, a structure may be provided that is capable of introducing condensed water, present between the first drying duct drain outlet 710 and the drying fan housing connector 143, into the first drying duct drain outlet 710.

The outer rib 720 may be formed along the entire anteroposterior length of the first drying duct 141 excluding a rear portion thereof.

Figure 15:
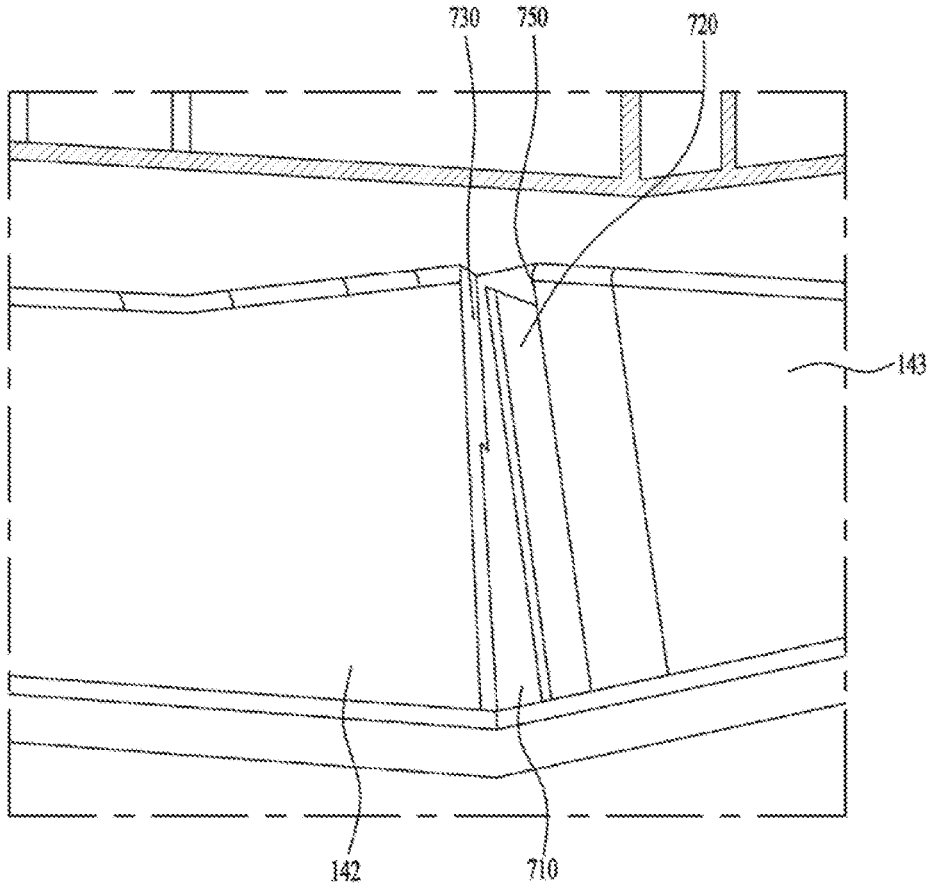
FIG. 15 is an enlarged perspective view showing the condensed water-discharging structure shown in FIG. 12.

As shown in FIG. 15, the outer rib 720 is not formed at the rear portion of the anteroposterior width of the first drying duct 141. A gap 750, through which condensed water flows into the first drying duct drain outlet 710, may be defined. Since the gap 750 is formed at the area at which the flow rate of air is lowest, upon suction of air, the amount of air that flows over the gap 750 may be relatively small. Accordingly, when the suction of air does not occur, condensed water may flow through the gap 750. The drying fan housing connector 143 of the first drying duct 141 may be inclined downward and toward the first drying duct drain outlet 710, thereby offering smooth discharge.

In contrast to the outer rib 720, the inner rib 730 may not be formed at the front portion of the anteroposterior length of the first drying duct 141. This is because a communicating portion 740 is provided under the inner rib 730. The communicating portion 740 is connected to the sump 66 through an inner channel. Consequently, condensed water, which flows into the first drying duct drain outlet 710, may flow into the sump 66 through the communicating portion 740 and the inner channel.

Accordingly, condensed water in the first drying duct 141 may be efficiently discharged through the condensed water-discharging structure 700 regardless of whether the drying machine is running or is shut down. Therefore, condensed water may be prevented from flowing into the drying fan housing 146, the heater 60 and the drum 10.

Another embodiment of the condensed water-discharging structure may be described with reference to FIGS. 16 to 18. This embodiment may be constructed in accordance with the above-described condensed water-discharging structure 700. This embodiment may be applied to the common base 100 of the drying machine.

Figure 16:
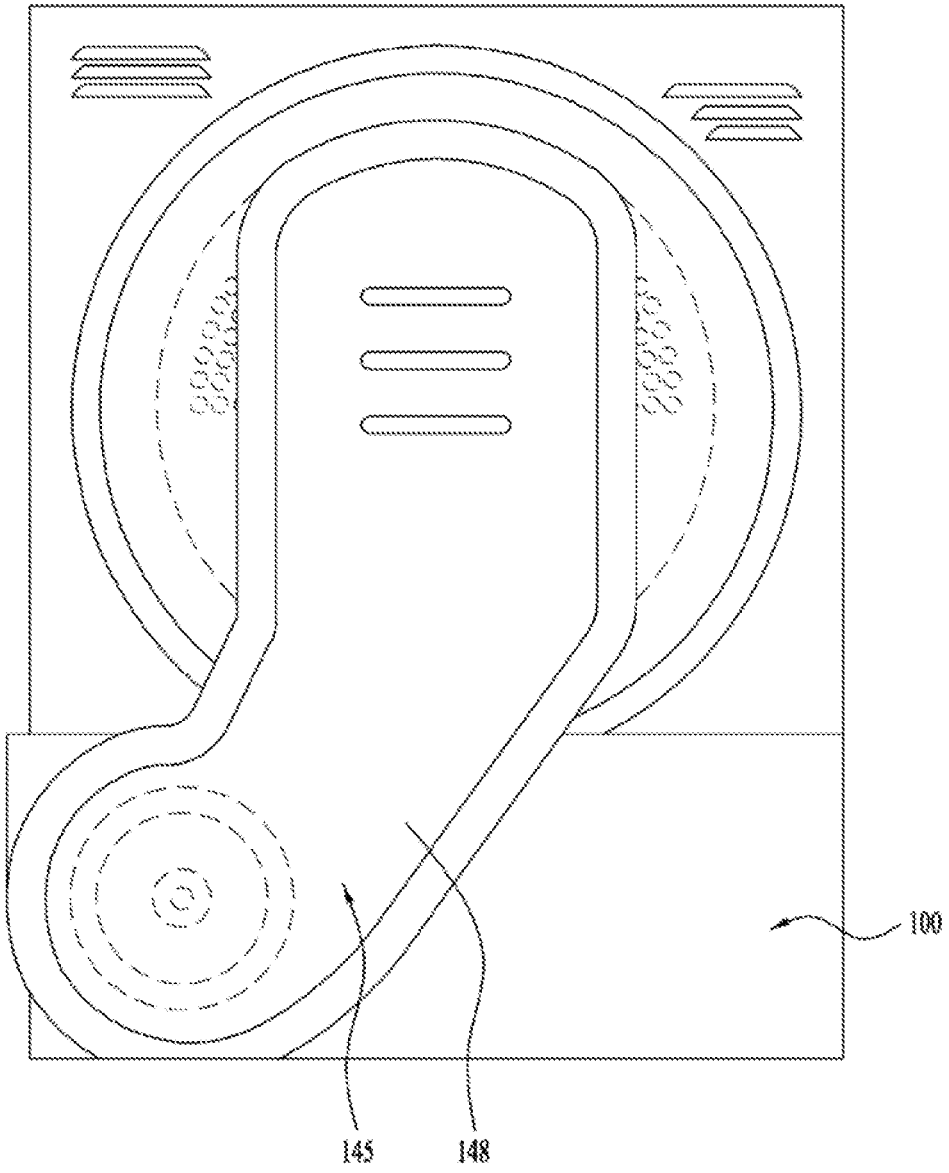
FIG. 16 is a rear view showing a back surface of a drying machine according to an example arrangement.

FIG. 16 illustrates a back surface of the drying machine. The back surface of the drying machine may be provided with a duct cover 148. The duct cover 148 may be connected at one end thereof to the drying fan housing 146 and at the other end thereof to the drum 10. Accordingly, the duct cover 148 may constitute a part of the second drying duct 145.

Figure 17:
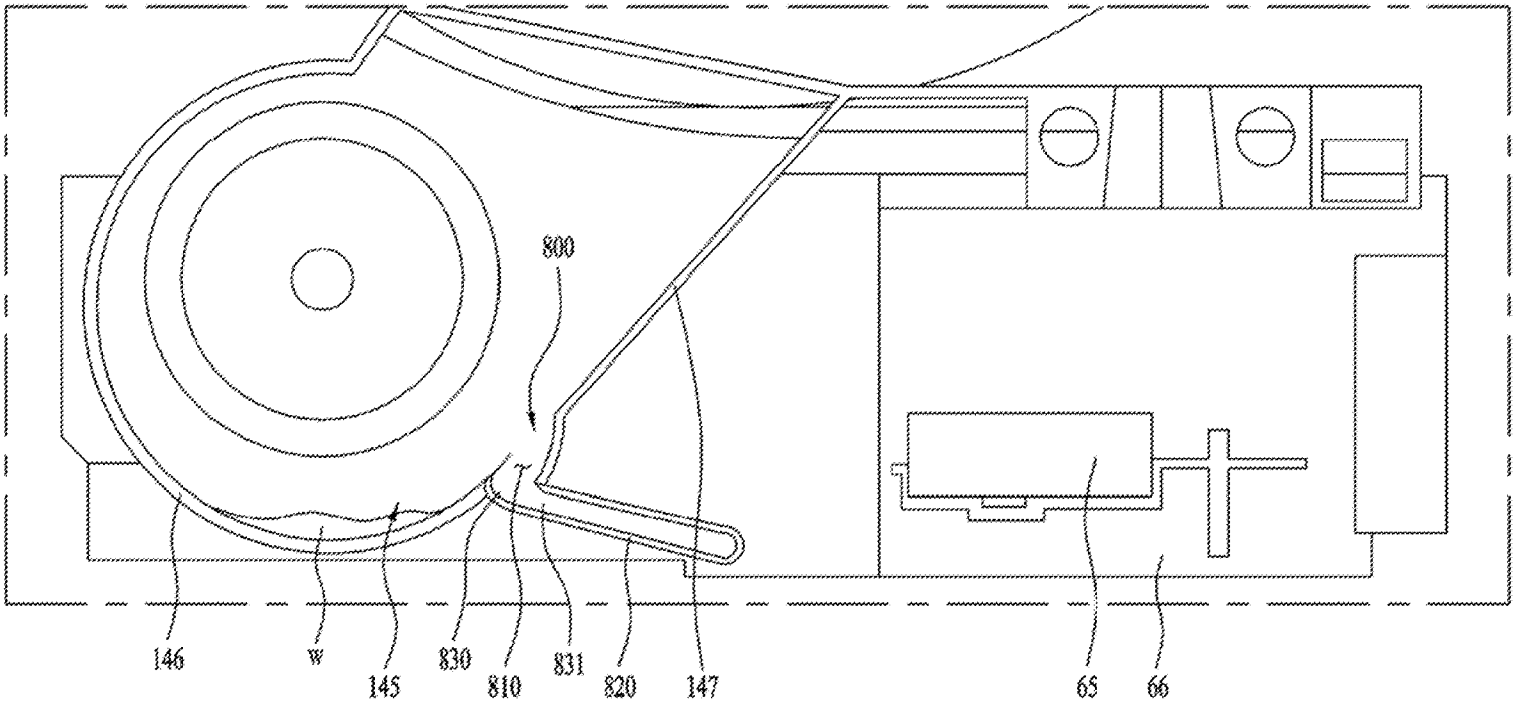
FIG. 17 is a cross-sectional view showing a base including a condensed water-discharging structure of a drying machine according to an example embodiment.
Figure 18:
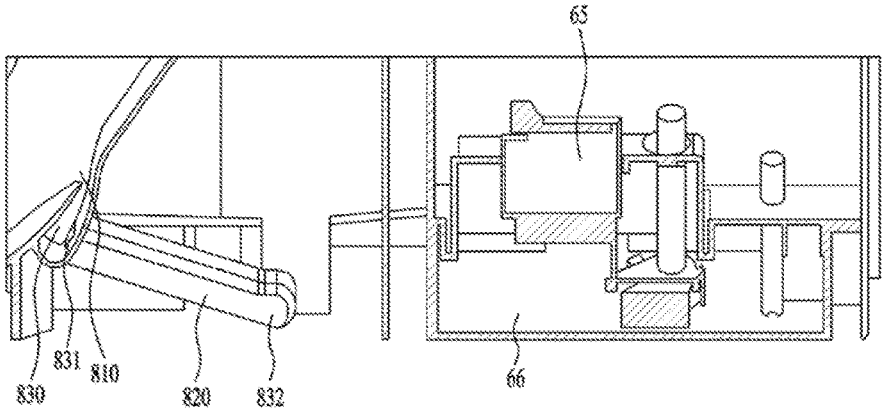
FIG. 18 is a longitudinal cross-sectional view showing the condensed water-discharging structure shown in FIG. 17.

FIG. 17 illustrates a portion of the second drying duct 145 formed at the base 100, from which the duct cover 148 is removed.

The drying fan housing 146 may be configured to have a circular shape, and may be disposed at a lowest position of the second drying duct 145. Consequently, condensed water may be collected in the lowest portion of the drying fan housing 146. The duct cover 148 may be disposed at the rearmost position of the drying machine, and may contact external air. Accordingly, the duct cover 148 may be the component that decreases in temperature soonest when the drying machine is shut down. For this reason, a large amount of condensed water may be generated in the duct cover 148, and may be collected in the drying fan housing 146.

As the drying fan 55 operates, the condensed water may increase along the second drying duct 145. The condensed water may flow into the heater 60.

A drain outlet may be provided at the lowermost position of the drying fan housing 146. Condensed water may be discharged by providing the drain outlet at the position where the condensed water is collected. However, a difference between the lowermost portion of the drying fan housing 146 and the bottom surface of the base 100 may not be great, thereby making it difficult to ensure natural discharge of condensed water caused by the difference in hydraulic head pressure. Even if the natural discharge of condensed water is allowed, this may incur a greater risk of back-flow of condensed water due to the natural discharge.

The condensed water-discharging structure 800 may be characteristically constructed such that a second drying duct drain outlet 810 is provided at one side surface of the drying fan housing 146, rather than at the lowermost position thereof.

The second drying duct drain outlet 810 may be provided in an inclined inner surface 147 of the drying fan housing 146, which is inclined upward and toward the drum from the lowermost portion of the drying fan housing 146. In other words, the second drying duct drain outlet 810 may be positioned higher than the lowermost portion of the drying fan housing 146.

As the drying fan operates, the condensed water w (shown in FIG. 17) may rise along the inner surface of the drying fan housing 146. Subsequently, the rising condensed water may, flow, into the second drying duct drain outlet 810. Meanwhile, condensed water, generated when the drying machine is shut down, may flow downward and be introduced into the second drying duct drain outlet 810.

The second drying duct drain outlet 810 may be formed by the discontinuous region between the inner surface of the drying fan housing and the inclined inner surface of the second drying duct.

The lower and inner surface of the second drying duct may extend further downward from the second drying duct drain outlet 810 and may be connected to the outer surface of the drying fan housing so as to provide a second drying duct drain pocket 830. The drain pocket 830 may be a space in which condensed water that has flowed thereinto through the drain outlet 810 may be temporarily stored.

The drain pocket 830 may be provided with a communicating hole 831. The communicating hole 831 may be connected to a drain connecting channel 820, and the drain connecting channel 820 may be connected to the sump 66. Consequently, condensed water having flowed into the drain outlet 810 may flow into the sump 66 through the drain connecting channel 820.

The drain connecting channel 820 may be inclined downward. Since the drain connecting channel 820 is connected to the sump 66, a level of condensed water in the drain connecting channel 820 may be substantially the same as the level of condensed water in the sump 66. Accordingly, by providing the drain outlet 810 at a position higher than the communicating hole 831 (in the drain connecting channel 820), the condensed water may be more efficiently discharged. In other words, by providing the drain outlet 810 at a position higher than the allowable maximum level of condensed water in the sump 66, condensed water may be more efficiently discharged.

Embodiments may offer the following advantageous effects.

Embodiments may provide a drying machine that includes a base adapted to be used in common regardless of a type (or kind) of drying machine.

Embodiments may provide a drying machine, which is intended to reduce, by virtue of the common base, a total number of components that would otherwise be increased due to application to different types of drying machines, thereby facilitating manufacture and subsequent management thereof.

Embodiments may provide a drying machine, in which an air circulating unit formed at a base has the same channel structure regardless of the type of drying machine, based on a common base.

Embodiments may provide a drying machine, which is constructed such that only additional components, required for variation of a flow channel due to change of the type of drying machine, are coupled to a base, thereby minimizing the number of parts of the drying machine to be managed.

Embodiments may provide a drying machine, which is constructed to have the same mounting structure between components exclusive to respective types of drying machines and a base, thereby facilitating the manufacture thereof.

Embodiments may provide a drying machine that is able to efficiently prevent condensed water from flowing into a drum, a drying fan housing and a heater regardless of the type of drying machine.

Embodiments may provide a drying machine, which includes a base having a condensed water-discharging structure, thereby efficiently discharging condensed water regardless of the type of drying machine. Consequently, the condensed water-discharging structure may not need to be designed repeatedly in accordance with the types of drying machines.

Embodiments may provide a drying machine that is able to efficiently remove condensed water, which is introduced into a drying fan housing from a condenser, thereby preventing the condensed water from flowing into a heater.

Embodiments may provide a drying machine, which is able to efficiently remove condensed water generated in a drying fan housing, thereby preventing the condensed water from flowing into a heater.

Embodiments may be directed to a drying machine that substantially obviates one or more problems due to limitations and disadvantages of disadvantageous arrangements.

An embodiment may provide a drying machine that includes a base adapted to be used in common regardless of the type of drying machine.

An embodiment may provide a drying machine that is intended to reduce, based on the common base, a number of components thereof, which would otherwise be increased due to application to different types of drying machines, thereby facilitating manufacture and subsequent management thereof.

An embodiment may provide a drying machine, in which an air circulating unit formed in the base may have the same channel structure regardless of the type of drying machine, based on the common base.

An embodiment may provide a drying machine that is constructed such that only additional components, required for variation of a flow channel due to change of the type of drying machine, are coupled to the base, thereby minimizing the number of parts of a drying machine to be managed.

An embodiment may provide a drying machine that is constructed to have a same mounting structure between the base and components that are exclusive to respective types of drying machines, thereby facilitating the manufacture thereof.

An embodiment may provide a drying machine that is able to efficiently prevent condensed water from flowing into a drum, a drying fan housing and a heater regardless of the type of drying machine.

An embodiment may provide a drying machine that includes a base having a condensed water-discharging structure, thereby efficiently discharging condensed water regardless of the type of drying machine. Consequently, various condensed water-discharging structures may not need to be repeatedly designed corresponding to respective types of drying machines.

An embodiment may provide a drying machine that is able to efficiently remove condensed water, which is introduced into a drying fan housing from a condenser, thereby preventing the condensed water from flowing into a heater.

An embodiment may provide a drying machine, which is able to efficiently remove condensed water generated in a drying fan housing, thereby preventing the condensed water from flowing into a heater.

To achieve these objects and other advantages and in accordance with the purpose of the embodiments, as embodied and broadly described herein, a drying machine includes a condensation duct for accommodating a condenser, a first drying duct connected to a rear end of the condensation duct and to a drying fan housing accommodating a drying fan, a second drying duct connected to the drying fan housing and to a drum, a first drying duct drain outlet formed in the lower portion of the first drying duct, and an outer rib, which is provided at the side edge of the first drying duct drain outlet that is close to the drying fan housing and which extends upward so as to prevent condensed water, introduced through the condensation duct, from flowing over the first drying duct drain outlet.

The drying machine may include a drum for containing clothes to be dried, an air circulation unit for circulating air through the drum, and a motor for driving a drying fan for the circulation of air. The condenser is constructed so as to condense the moisture contained in circulating air introduced from the drum. The drying machine may include a heater for heating the circulating air introduced from the condenser, and a base, which is provided under the drum so as to support the drum and which constitutes the lower part of the drying machine.

The drying machine may include a condensed water-discharging structure for preventing condensed water, generated from an air circulating unit, from flowing along the air circulating unit into the drum.

The condensed water-discharging structure may include the first drying duct drain outlet and the outer rib.

The air circulating unit may include the condensation duct, the first drying duct and the second drying duct.

The first drying duct may be provided at the lower portion of the drying machine so as to laterally extend from the condensation duct to the drying fan housing.

The drying fan housing may be spaced apart from the condensation duct by means of the first drying duct. The first drying duct drain outlet may extend so as to span the entire anteroposterior inner length of the first drying duct.

The first drying duct drain outlet may be formed in a transverse direction of the first drying duct.

The transverse width of the first drying duct drain outlet may increase towards the front end from the rear end thereof. The reason for this is because the flow rate of circulating air in the first drying duct is higher at the front end than at the rear end. Therefore, it is possible to efficiently discharge condensed water by virtue of the difference in width.

The outer rib may be inclined so as to be perpendicular to an oblique line that connects the centers of opposite ends of the first drying duct.

The outer rib may be inclined upward toward the condensation duct. By virtue of the upward inclination of the outer rib, it is possible to reduce resistance to flow.

The outer rib may be formed along the entire anteroposterior inner length of the first drying duct, excluding the rear portion thereof, such that the condensed water in the first drying duct, which has passed over the first drying duct drain outlet, is introduced into the first drying duct drain outlet.

Condensed water may also be generated in the first drying duct between the first drying duct drain outlet and the drying fan housing. The condensed water may be generated due to a temperature drop after the operation of the drying machine is stopped. Accordingly, the outer rib may be formed along the entire anteroposterior inner length of the first drying duct, excluding the rear portion thereof, such that condensed water is introduced into the first drying duct drain outlet.

The relative flow rate of circulating air is reduced in the rear portion of the first drying duct. Accordingly, the outer rib is not formed at the rear portion, because the amount of condensed water that flows over the rear portion is relatively small.

The angle between the outer rib and the bottom surface of the first drying duct may be within a range of 25 to 35 degrees.

The drying machine may further include an inner rib, which is provided at the side edge of the first drying duct drain outlet, which is close to the condensation duct and extends downwards, so as to prevent condensed water from flowing back through the first drying duct drain outlet. The reason for this is because discharged condensed water may flow into the drying fan housing due to the negative pressure caused by air suction of the drying fan. By virtue of the inner rib, it is possible to prevent condensed water, introduced into the first drying duct drain outlet, from being discharged through the first drying duct drain outlet.

The inner, rib may be inclined downward toward the condensation duct.

The angle between the inner rib and the bottom surface of the first drying duct may be within a range of 130 to 140 degrees.

A condensation duct mount, on which the first drying duct, the drying fan housing and the condensation duct are mounted, may be integrally formed with the base.

The second drying duct may include a duct cover, which defines the rear outer surface of the drying machine and which is connected at one end thereof to the drying fan housing and at the other end thereof to the drum.

The drying machine may further include a second drying duct drain outlet, which is provided in the inclined inner surface of the drying fan housing, which is inclined upward toward the drum from the lowermost portion of the drying fan housing, and which is positioned higher than the lowermost portion of the drying fan housing.

The second drying duct may be integrally formed with the base.

The second drying duct drain outlet may be formed by a discontinuous region between the inner surface of the drying fan housing and the inclined inner surface of the second drying duct.

The inclined inner surface of the second drying duct may extend further downward from the second drying duct drain outlet and may be connected to the outer surface of the drying fan housing so as to provide a second drying duct drain pocket.

The drain pocket may be provided under the second drying duct drain outlet and the inner surface of the drying fan housing so as to temporarily store condensed water that has flowed thereinto through the second drying duct drain outlet from the drying fan housing and the second drying duct.

The drying machine may further include a sump for storing condensed water, and a drain connecting channel, which communicates at one end thereof with the second drying duct drain outlet and at the other end thereof with the sump.

The sump may be formed in the base. In particular, the sump may be integrally formed in the base. Accordingly, the sump may store all of the condensed water introduced from the condenser, the condensed water introduced through the first drying duct and the condensed water introduced through the second drying duct.

The drain connecting channel may be inclined downward such that the level of condensed water in the drain connecting channel is the same as the level of condensed water in the sump.

The second drying duct drain outlet may be positioned higher than the allowable maximum level of condensed water in the sump.

In an example embodiment, a drying machine includes a base, which is provided under the drum so as to support the drum and which constitutes the lower part of the drying machine, a sump, which is provided in the base so as to store condensed water, a condensation duct for accommodating a condenser, a first drying duct connected to the rear end of the condensation duct and to a drying fan housing, which accommodates a drying fan, a second drying duct, connected to the drying fan housing and to a drum, and a condensed water-discharging structure for preventing condensed water generated from the drying fan housing and the second drying duct from flowing into the drum, wherein the condensed water-discharging structure includes a second drying duct drain outlet, which is provided in the inclined inner surface of the drying fan housing, which is inclined upward toward the drum from the lowermost portion of the drying fan housing such that condensed water in the drying fan housing is naturally discharged into the sump due to the height difference between the condensed water in the drying fan housing and the condensed water in the sump.

In an example embodiment, a drying machine includes a condensation duct for accommodating a condenser, a first drying duct connected between the rear end of the condensation duct and a drying fan housing, which accommodates a drying fan, a second drying duct connected to the drying fan housing and to a drum, a first drying duct drain outlet formed in the lower portion of the first drying duct, an outer rib, which is provided at the side edge of the first drying duct drain outlet that is close to the drying fan housing and which extends upward so as to prevent condensed water, introduced through the condensation duct, from flowing over the first drying duct drain outlet, and a second drying duct drain outlet, which is provided in the inclined inner surface of the drying fan housing, which is inclined upward toward the drum from the lowermost portion of the drying fan housing, such that condensed water in the drying fan housing is naturally discharged into the sump due to the height difference between the condensed water in the drying fan housing and the condensed water in the sump.

The above-described respective embodiments may be combined in various ways, so long as the features of such embodiments are not contradictory to or exclusive of one another.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drying machine comprising:

a condensation duct to accommodate a condenser;

a first drying duct comprising a condensation duct connector and a drying fan housing connector, the condensation duct connector to couple to an end of the condensation duct, the drying fan housing connector to couple to a drying fan housing, and the drying fan housing to accommodate a drying fan;

a second drying duct to couple to the drying fan housing and to a drum;

a first drying duct drain outlet at a lower portion of the first drying duct; and an outer rib, at a side of the first drying duct drain outlet that is closer to the drying fan housing, the outer rib to extend upward, the outer rib to prevent at least a portion of condensed water from flowing over the first drying duct drain outlet, wherein the drying fan housing connector is inclined downward and toward the first drying duct drain outlet.

2. The drying machine according to claim 1, wherein the first drying duct laterally extends from the condensation duct to the drying fan housing.

3. The drying machine according to claim 2, wherein the drying fan housing is spaced apart from the condensation duct by the first drying duct.

4. The drying machine according to claim 3, wherein the first drying duct drain outlet extends an entire anteroposterior inner length of the first drying duct.

5. The drying machine according to claim 4, wherein a transverse width of the first drying duct drain outlet increases from a rear end of the first drying duct drain outlet toward a front end of the first drying duct drain outlet.

6. The drying machine according to claim 4, wherein the outer rib is perpendicular to a virtual oblique line that connects a center of the condensation duct connector with a center of the drying fan housing.

7. The drying machine according to claim 1, wherein the outer rib is inclined toward the condensation duct.

8. The drying machine according to claim 7, wherein the outer rib is along an entire anteroposterior inner length of the first drying duct, excluding a rear portion of the first drying duct, such that the condensed water in the first drying duct, which has passed over the first drying duct drain outlet, is introduced into the first drying duct drain outlet.

9. The drying machine according to claim 7, wherein an angle between the outer rib and a bottom surface of the first drying duct is within a range of 25 to 35 degrees.

10. The drying machine according to claim 7, further comprising an inner rib, at a side of the first drying duct drain outlet that is closer to the condensation duct, and the inner rib to extend downwards, the inner rib to prevent at least a portion of condensed water from flowing back from the first drying duct drain outlet and towards the first drying duct.

11. The drying machine according to claim 10, wherein the inner rib is inclined downward toward the drying fan housing.

12. The drying machine according to claim 1, wherein the second drying duct includes a duct cover that defines a rear surface of the drying machine, wherein a first end of the duct cover to couple to the drying fan housing and a second end of the duct cover to couple to the drum.

13. The drying machine according to claim 12, further comprising a second drying duct drain outlet provided at a surface of the drying fan housing that is inclined upward toward the drum from a lower portion of the drying fan housing, and one end of the second drying duct drain outlet is positioned higher than the lower portion of the drying fan housing.

14. The drying machine according to claim 13, wherein the second drying duct drain outlet is formed by a discontinuous region between the surface of the drying fan housing and a surface of the second drying duct.

15. The drying machine according to claim 14, wherein the surface of the second drying duct extends further downward from the second drying duct drain outlet and is coupled to an outer surface of the drying fan housing to provide a drying duct drain pocket.

16. The drying machine according to claim 15, wherein the drying duct drain pocket is provided under the end of the second drying duct drain outlet and the surface of the drying fan housing to temporarily store condensed water that has flowed from the drying fan housing and the second drying duct and through the second drying duct outlet.

17. The drying machine according to claim 13, further comprising:

a sump to store condensed water; and a drain connecting channel that communicates at a first end thereof with the second drying duct drain outlet and at a second end thereof with the sump.

18. The drying machine according to claim 17, wherein the drain connecting channel is inclined downward such that a level of condensed water in the drain connecting channel is same as a level of condensed water in the sump.

19. The drying machine according to claim 18, wherein the second drying duct drain outlet is positioned higher than an allowable maximum level of condensed water in the sump.

20. A drying machine comprising:

a condensation duct to accommodate a condenser;

a first drying duct that includes a condensation duct connector and a drying fan housing connector, the condensation duct connector to couple to an end of the condensation duct, the drying fan housing connector to couple to a drying fan housing, and the drying fan housing to accommodate a drying fan;

a first drying duct drain outlet at a lower portion of the first drying duct;

a second drying duct to couple to the drying fan housing and to a drum;

a sump to store condensed water; and a second drying duct drain outlet provided at an area on a surface of the drying fan housing that is inclined upward from a lower portion of the drying fan housing to the drum such that condensed water in the drying fan housing is to discharge to the sump due to a height difference between the condensed water in the drying fan housing and the condensed water in the sump, wherein the area of the second drying duct drain outlet is higher than the lower portion of the drying fan housing, wherein the drying fan housing connector is inclined downward and toward the first drying duct drain outlet.

21. The drying machine according to claim 20, wherein the second drying duct drain outlet is formed by a discontinuous region between the surface of the drying fan housing and a surface of the second drying duct that is inclined downward from the drum toward the drying fan housing.

22. The drying machine according to claim 21, further comprising:

a drying duct drain pocket provided under the second drying duct drain outlet to store condensed water; and a drain connecting channel that is inclined downward toward the drying duct drain pocket from the second drying duct drain outlet.

23. A drying machine comprising:

a condensation duct to accommodate a condenser;

a first drying duct that includes a condensation duct connector and a drying fan housing connector, the condensation duct connector to couple to a rear end of the condensation duct, and the drying fan housing connector to couple to a drying fan housing that accommodates a drying fan;

a second drying duct to couple between the drying fan housing and a drum;

a sump to store condensed water;

a first drying duct drain outlet at a lower portion of the first drying duct;

an outer rib, at a side of the first drying duct drain outlet closer to the drying fan housing, and the outer rib to extend upward to prevent a portion of condensed water from flowing over the first drying duct drain outlet; and a second drying duct drain outlet, at an inclined surface of the drying fan housing that is inclined upward from a lower portion of the drying fan housing to the drum such that condensed water in the drying fan housing is to discharge into the sump due to a height difference between the condensed water in the drying fan housing and the condensed water in the sump, wherein the drying fan housing connector is inclined downward and toward the first drying duct drain outlet.

* * * * *